US006081681A

United States Patent [19]

Nagase et al.

[11] Patent Number: 6,081,681

[45] Date of Patent: Jun. 27, 2000

[54] CHARGING DEVICE, CHARGING METHOD, PROCESS CARTRIDGE AND IMAGE FORMING APPARATUS

[75] Inventors: Yukio Nagase, Shizuoka; Harumi Ishiyama, Numazu; Yasunori Chigono, Susono; Jun Hirabayashi, Numazu, all of Japan

[73] Assignee: Canon Kabushiki Kaisha, Tokyo, Japan

[21] Appl. No.: 09/035,108

[22] Filed: Mar. 5, 1998

[30] Foreign Application Priority Data

Mar. 5, 1997 [JP] Japan ..... 9-067423

[51] Int. Cl.[7] ..... G03G 15/02

[52] U.S. Cl. ..... 399/174; 399/175; 430/902

[58] Field of Search ..... 399/174, 175, 399/176; 430/902

[56] References Cited

U.S. PATENT DOCUMENTS 5,177,537 1/1993 Okano et al. ..... 355/259

5,241,342 8/1993 Asano et al. ..... 399/175

5,678,136 10/1997 Watanabe et al. ..... 399/100

5,682,585 10/1997 Yamaguchi et al. ..... 399/274

FOREIGN PATENT DOCUMENTS 7-152222 6/1995 Japan .

*Primary Examiner*—Joan Pendegrass

*Attorney, Agent, or Firm*—Fitzpatrick, Cella, Harper & Scinto

[57] ABSTRACT

A charging device includes a charging member to which a voltage is applicable to charge a member to be charged, the charging member including a flexible member for forming a nip with the member to be charged, wherein the flexible member is moved to provide a speed difference between a surface of the member to be charged and a surface of the flexible member; wherein not less than $10^2/mm^2$ electroconductive particles are provided in the nip.

51 Claims, 6 Drawing Sheets

CHARGING DEVICE, CHARGING METHOD, PROCESS CARTRIDGE AND IMAGE FORMING APPARATUS

FIELD OF THE INVENTION AND RELATED ART

The present invention relates to a charging device, a charging method, a process cartridge and an image forming apparatus, wherein member to be charged such as an image bearing member is electrically charged by electroconductive particles.

Heretofore, a corona type charger (corona discharging device) has been widely used as a charging apparatus for charging (inclusive of discharging) an image bearing member (object to be charged) such as an electrophotographic photosensitive member or an electrostatic dielectric recording member to a predetermined polarity and a predetermined potential level in an image forming apparatus, for example, an electrophotographic apparatus (copying machine, printer, or the like) or an electrostatic recording apparatus.

The corona type charging device is a non-contact type charging device, and comprises a corona discharging electrode such as a wire electrode, and a shield electrode which surrounds the corona discharging electrode. It is disposed so that corona discharging opening thereof faces an image bearing member, that is, an object to be charged. In usage, the surface of an image bearing member is charged to a predetermined potential level by being exposed to discharge current (corona shower) generated as high voltage is applied between the corona discharging electrode and the shield electrode.

Recently, it has been proposed to employ a contact type charging apparatus as a charging apparatus for charging the image bearing member, that is, the object to be charged, in an image forming apparatus of low to medium speed. This is due to the fact that contact type charging apparatus has an advantage over a corona type charging apparatus in terms of low ozone production, low power consumption, or the like. Also, such a contact type charging apparatus has been put to practical use.

In order to charge an object such as an image bearing member with the use of a contact type charging apparatus, the electrically conductive charging member (contact type charging member, contact type charging device, or the like) of a contact type apparatus is placed in contact with the object to be charged, and an electrical bias (charge bias) of a predetermined level is applied to this contact type charging member so that surface of the object to be charged is charged to a predetermined polarity and a predetermined potential level. The charging member is available in various forms, for example, a roller type (charge roller), a fur brush type, a magnetic brush type, a blade type, and the like.

When an object is electrically charged by a contact type charging member, two types of charging mechanisms (charging mechanism or charging principle: (1) mechanism which discharges electrical charge, and (2) mechanism for injecting charge) come into action. Thus, the characteristics of each of contact type charging apparatuses or methods are determined by the charging mechanism which is the dominant one of the two in charging the object.

(1) Electrical discharge based charging mechanism

In this charging mechanism, the surface of an object to be charged is charged by electrical discharge which occurs across a microscopic gap between a contact type charging member and the object to be charged.

In the case of the electrical discharge based charging mechanism, there is a threshold voltage which must be surpassed by the charge bias applied to a contact type charging member before electrical discharge occurs between a contact type charging member and an object to be charged, and therefore, in order for an object to be charged through the electrical discharge based charging mechanism, it is necessary to apply to the contact type charging member a voltage with a value greater than the value of the potential level to which the object is to be charged. Thus, in principle, when the electrical discharge based charging mechanism is in action, the discharge product is unavoidable, that is, active ions such as ozone ions are produced, even though the amount thereof is remarkably small.

(2) Direct charge injection mechanism

This is a mechanism in which the surface of an object to be charged is charged as electrical charge is directly injected into the object to be charged, with the use of a contact type charging member. Thus, this mechanism is called "direct charging mechanism", or "charge injection mechanism". More specifically, a contact type charging member with medium electrical resistance is placed in contact with the surface of an object to be charged to directly inject electrical charge into the surface portion of an object to be charged, without relying on electrical discharge, in other words, without using electrical discharge in principle. Therefore, even if the value of the voltage applied to a contact type charging member is below the discharge starting voltage value, the object to be charged can be charged to a voltage level which is substantially the same as the level of the voltage applied to the contact type charging member.

This direct injection charging mechanism does not suffer from the problems caused by the by-product of electrical discharge since it is not accompanied by ozone production. However, in the case of this charging mechanism, the state of the contact between a contact type charging member and an object to be charged greatly affects the manner in which the object is charged, since this charging mechanism is such a mechanism that directly charges an object. Thus, this direct injection charging mechanism should comprise a contact type charging member composed of high density material, and also should be given a structure which provides a large speed difference between the charging member and the object to be charged, so that given point on the surface of the object to be charged makes contact with a larger area of the charging member.

A) Charging apparatus with charge roller

In the case of a contact type charging apparatus, a roller charge system, that is, a charging system which employs an electrically conductive roller (charge roller) as a contact type charging member, is widely used because of its desirability in terms of safety.

As for the charging mechanism in this roller charge system, the aforementioned (1) charging mechanism, which discharges electrical charge, is dominant.

Charge rollers are formed of rubber or foamed material with substantial electrical conductivity, or electrical resistance of a medium level. In some charge rollers, the rubber or foamed material is layered to obtain a specific characteristic.

In order to maintain stable contact between a charge roller and an object to be charged (hereinafter, "photosensitive member"), a charge roller is given elasticity, which in turn increases frictional resistance between the charge roller and the photosensitive member. Also in many cases, a charge roller is rotated by the rotation of a photosensitive drum, or is individually driven at a speed slightly different from that of the photosensitive drum. As a result, problems occur: absolute charging performance declines, the state of the contact between the charge roller and the photosensitive drum becomes less desirable, and foreign matter adheres to the charge roller and/or the photosensitive member. With conventional charging roller, the dominant charging mechanism through which a roller charging member charged an object was a corona charging mechanism.

FIG. 9 is a graph which shows an example of efficiency in contact type charging. In the graph, the abscissas represents the bias applied to a contact type charging member, and the axis of ordinate represents the potential levels correspondent to the voltage values of the bias applied to the contact type charging member. The characteristics of the charging by a roller are represented by a line designated by a character A. According to this line, when a charge roller is used to charge an object, the charging of an object occurs in a voltage range above an electric discharge threshold value of approximately −500 V. Therefore, generally, in order to charge an object to a potential level of −500 V with the use of a charge roller, either a DC voltage of −1,000 V is applied to the charge roller, or an AC voltage with a peak-to-peak voltage of 1,200 V, in addition to a DC voltage of −500 V, is applied to the charge roller to keep the difference in potential level between the charge roller and the object to be charged, at a value greater than the electric discharge threshold value, so that potential of the photosensitive drum converges to the desired potential level.

More specifically, in order to charge a photosensitive drum with a 25 microns thick organic photoconductor layer by pressing a charge roller upon the photosensitive member, charge bias with a voltage value of approximately 640 V or higher should be applied to the charge roller. Where the value of the charge bias is approximately 640 V or higher, the potential level at the surface of the photosensitive member is proportional to the level of the voltage applied to the charge roller; the relationship between the potential level and the voltage applied to the charge roller is linear. This threshold voltage is defined as a charge start voltage $V_{th}$.

In other words, in order to charge the surface of a photosensitive member to a potential level of $V_d$ which is necessary for electrophotography, a DC voltage of $(V_d+V_{th})$, which is higher than the voltage level to which the photosensitive member is to be charged, is necessary. Hereinafter, the above described charging method in which only DC voltage is applied to a contact type charging member to charge an object will be called "DC charging method".

However, with the use of the DC charging method, it was difficult to bring the potential level of a photosensitive member exactly to a target level, since the resistance value of a contact charging member changed due to changes in ambience or the like, and also the threshold voltage $V_{th}$ changed as the photosensitive member was shaved away.

As for a counter measure for the above described problem, Japanese Laid-Open Patent Application No. 149, 669/1988 discloses an invention which deals with the above problem to effect more uniform changing of a photosensitive member. According to this invention, a "AC charging method" is employed, in which a compound voltage composed of a DC component equivalent to a desired potential $V_d$, and an AC component with a peak-to-peak voltage which is twice the threshold voltage $V_{th}$, is applied to a contact type charging member. This is intended to utilize the averaging effect of alternating current. That is, the potential of an object to be charged is caused to converge to the $V_d$, that is, the center of the peaks of the AC voltage, without being affected by external factors such as operational ambience.

However, even in the case of the contact type charging apparatus in the above described invention, the principal charging mechanism is a charging mechanism which uses electrical discharge from a contact type charging member to a photosensitive member. Therefore, as already described, the voltage applied to the contact type charging member needs to have a voltage level higher than the voltage level to which the photosensitive member is to be charged. Thus, ozone is generated, although only in a small amount.

Further, when AC current is used so that object is uniformly charged due to the averaging effect of AC current, the problems related to AC voltage become more conspicuous. For example, more ozone is generated; noises traceable to the vibration of the contact type charging member and the photosensitive drum caused by the electric field of AC voltage increase; the deterioration of the photosensitive member surface caused by electrical discharge increases, which add to the prior problems.

B) Charging apparatus with fur brush

In the case of this charging apparatus, a charging member (fur brush type charging device) with a brush portion composed of electrically conductive fiber is employed as the contact type charging member. The brush portion composed of electrically conductive fiber is placed in contact with a photosensitive member as an object to be charged, and a predetermined charge bias is applied to the charging member to charge the peripheral surface of the photosensitive member to a predetermined polarity and a predetermined potential level.

Also in the case of this charging apparatus with a fur brush, the dominant charging mechanism is the electrical discharge based charging mechanism.

It is known that there are two type of fur brush type charging devices: a fixed type and a roller type. In the case of the fixed type, fiber with medium electrical resistance is woven into foundation cloth to form pile, and a piece of this pile is adhered to an electrode. In the case of the rotatable type, the pile is wrapped around a metallic core. In terms of fiber density, pile with a density of 100 fiber/mm$^2$ can be relatively easily obtained, but the density of 100 fiber/mm$^2$ is not sufficient to create a state of contact which is satisfactory to charge an object by charge injection. Further, in order to give a photosensitive member satisfactorily uniform charge by charge injection, velocity difference which is almost impossible to attain with the use of a mechanical structure must be established between a photosensitive drum and a roller type fur brush. Therefore, the fur brush type charging device is not practical.

The relationship between the DC voltage applied to a fur brush type charging member and the potential level to which a photosensitive member is charged by the DC voltage applied to the fur brush shows a characteristic represented by a line B in FIG. 5. As is evident from the graph, also in the case of the contact type charging apparatus which comprises a fur brush, whether the fur brush is of the fixed type or the roller type, the photosensitive member is charged mainly through electrical discharge triggered by applying to the fur brush a charge bias the voltage level of which is higher than the potential level desired for the photosensitive member.

C) Magnetic brush type charging apparatus

A charging apparatus of this type comprises a magnetic brush portion (magnetic brush based charging device) as the contact type charging member. A magnetic brush is constituted of electrically conductive magnetic particles magnetically confined in the form of a brush by a magnetic roller or the like. This magnetic brush portion is placed in contact with a photosensitive member as an object to be charged, and a predetermined charge bias is applied to the magnetic brush to charge the peripheral surface of the photosensitive member to a predetermined polarity and a predetermined potential level.

In the case of this magnetic brush type charging apparatus, the dominant charging mechanism is the charge injection mechanism (2).

As for the material for the magnetic brush portion, electrically conductive magnetic particles, the diameters of which are in a range of 5–50 microns, are used. With the provision of sufficient difference in peripheral velocity between a photosensitive drum and a magnetic brush, the photosensitive member can be uniformly charged through charge injection.

In the case of a magnetic brush type charging apparatus, the photosensitive member is charged to a potential level which is substantially equal to the voltage level of the bias applied to the contact type charging member, as shown by a line C in FIG. 9.

However, a magnetic brush type charging apparatus also has its own problems. For example, it is complicated in structure. Also, the electrically conductive magnetic particles which constitute the magnetic brush portion become separated from the magnetic brush and adhere to a photosensitive member.

Japanese Patent Publication Application No. 3, 921/1994 discloses a contact type charging method, according to which a photosensitive member is charged by injecting electric charge into the charge injectable surface layer thereof, more specifically into the traps or electrically conductive particles in the charge injectable surface layer. Since this method does not rely on electrical discharge, the voltage level necessary to charge the photosensitive member to a predetermined potential level is substantially the same as the potential level to which the photosensitive member is to be charged, and in addition, no ozone is generated. Further, since AC voltage is not applied, there is no noise traceable to the application of AC voltage. In other words, a magnetic brush type charging system is an excellent charging system superior to the roller type charging system in terms of ozone generation and power consumption, since it does not generate ozone, and uses far less power compared to the roller type charging system.

D) Toner recycling process (cleanerless system)

In a transfer type image forming apparatus, the toner which remains on the peripheral surface of a photosensitive member (image bearing member) after image transfer is removed by a cleaner (cleaning apparatus) and becomes waste toner. Not only for obvious reasons, but also for environmental protection, it is desirable that waste toner is not produced. Thus, image forming apparatuses capable of recycling toner have been developed. In such an image forming apparatus, a cleaner is eliminated, and the toner which remains on the photosensitive member after image transfer is removed from the photosensitive drum by a developing apparatus; the residual toner on the photosensitive member is recovered by a developing apparatus at the same time as a latent image on the photosensitive drum is developed by the developing apparatus, and then is reused for development.

More specifically, the toner which remains on a photosensitive member after image transfer is recovered by fog removal bias (voltage level difference $V_{back}$ between the level of the DC voltage applied to a developing apparatus and the level of the surface potential of a photosensitive member) during the following image transfer. According to this cleaning method, the residual toner is recovered by the developing apparatus and is used for the following image development and thereafter; the waste toner is eliminated. Therefore, the labor spent for maintenance is reduced. Further, being cleanerless is quite advantageous in terms of space, allowing image forming apparatuses to be substantially reduced in size.

E) Coating of contact type charging member with electrically conductive powder

Japanese Laid-Open Patent Application No. 103, 878/1991 discloses a contact type charging apparatus with such a structure that coats a contact type charging member with electrically conductive powder, on the surface which comes in contact with the surface of an object to be charged, so that surface of the object to be charged is uniformly charged, that is, without irregularity in charge. The contact type charging member in this charging apparatus is rotated by the rotation of the object to be charged, and the amount of ozone generated by this charging apparatus is remarkably small compared to the amount of ozonic products generated by a corona type charging apparatus such as scorotron. However, even in the case of this charging apparatus, the principle based on which an object is charged, is the same as the principle, based on which an object is charged by the aforementioned charge roller; in other words, an object is charged by electrical discharge. Further, also in the case of this charging apparatus, in order to assure that object to be charged is uniformly charged, compound voltage composed of DC component and AC component is applied to the contact type charging member, and therefore, the amount of ozonic products traceable to electrical discharge becomes relatively large. Thus, even this contact type charging apparatus is liable to cause problems; for example, images are affected by ozonic products, appearing as if flowing, when this charging apparatus is used for an extended period of time, in particular, when this charging apparatus is used in a cleanerless image forming apparatus for an extended period of time.

As described in the preceding paragraphs regarding the technologies prior to the present invention, it is difficult to directly charge an object with the use of a contact type charging apparatus with a simple structure which comprises a contact type charging member such as a charge roller or a fur brush. Also in the case of an image forming apparatus which employs such a charging apparatus, the photosensitive member is liable to be insufficiently charged, causing images to appear foggy (during reversal development, toner is adhered to the areas which are supposed to remain white), or the photosensitive member is liable to be nonuniformly charged, causing image to be appear irregular in terms of continuity.

In the case of the contact type charging apparatus structured so that contact type charging member is coated with electrically conductive powder, on the surface which comes in contact with the surface of the object to be charged, so that contact type charging member is rotated by the rotation of the photosensitive member, and so that photosensitive member is mainly charged by electrical discharge, ozonic products are liable to be accumulated, and images are affected by the accumulated ozonic products, appearing as if flowing, when such a charging apparatus is used for an extended period of time, in particular, when such a charging apparatus is used in a cleanerless image forming apparatus for an extended period of time.

Further, in the case of the cleanerless image forming apparatus, there is the problem that residual toner causes the photosensitive member to be unsatisfactorily charged in a charging portion.

In the contact charging, it is necessary that contact between the member to be charged and the charging member is sufficient.

A) when conventional furbrushes (charging brushes) are used as the contact charging members, the fiber ends of the charging brush are divided as shown in FIG. 8, with the result that there is a portion where the brush does not contact the surface of the member to be charged, and therefore, the uniform charging of the surface of the member to be charged is deteriorated. In FIG. 8, designated by 1 is a member to be charged (for example, a photosensitive member); 2 is a charging brush; 2*a* is an electrode portion of the charging brush; 2*b* is a furbrush portion of the electroconductive fiber; and S1 is an electrode portion.

B) when the contact charging member is a magnetic brush, and the size of the charging magnetic particles are reduced in an attempt to improve the contact property, the magnetic particles tend to be deposited on the surface of the member to be charged. If the size of the charging magnetic particles are increased with sufficient magnetic confining force, the chances of contact of the magnetic particles to the member to be charged reduce with the result of reduction of the injection charging power.

C) it is proposed that auxiliary electroconductive magnetic fine particles are added to the charging member in order to improve the contact property in the magnetic brush charging, but the magnetic fine particles are deposited on the member to be charged in a long run and therefore are consumed, with the result of charging property reduction.

U.S. Pat. No. 5,432,037 discloses that electroconductive particles are mixed in the developer so as not to disturb the charging action even when the developer is deposited onto the charging roller. However, since it uses discharge for charging the member, it is not free of the problems described hereinbefore.

SUMMARY OF THE INVENTION

Accordingly, it is a principal object of the present invention to provide a charging device, a charging method, a process cartridge and an image forming apparatus, wherein uniform charging is maintained for a long term even if the use is made with a simple charging roller or fiber brush as the charging member.

It is another object of the present invention to provide a charging device, a charging method, a process cartridge and an image forming apparatus, wherein the applied voltage to the charging member can be reduced to accomplish the ozoneless charging operation.

It is a further object of the present invention to provide a charging device, a charging method, a process cartridge and an image forming apparatus, wherein the injection charging is accomplished from the charging member to the member to be charged at low cost.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

<Embodiment 1> (FIGS. 1–5)

Figure 1:
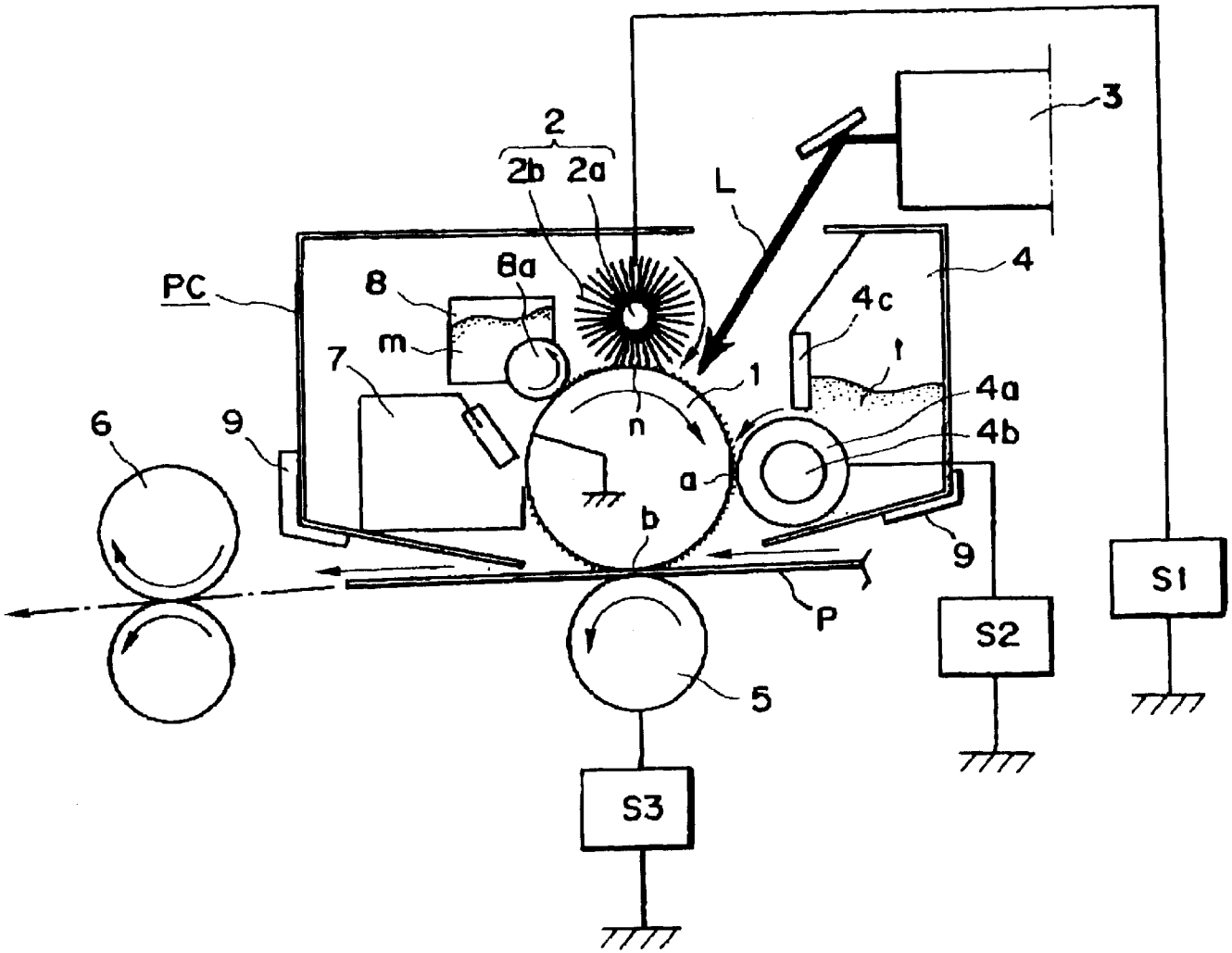
FIG. 1 is a schematic illustration of an image forming apparatus of Embodiment 1.

FIG. 1 shows an example of an image forming apparatus comprising a contact charging device according to an embodiment of the present invention. The image forming apparatus of this example is a laser beam printer of detachable process cartridge type and using a transfer type electrophotographic process.

(1) general arrangement of the exemplary printer

Designated by 1 is a rotatable drum type electrophotographic photosensitive member as an image bearing member (member to be charged). In this example, it is a negatively chargeable OPC photosensitive member having a diameter of 30 mm, and is rotated in the clockwise direction indicated by the arrow at a process speed (peripheral speed) of 100 mm/sec.

Designated by 2 is a roller-like charging brush (furbrush charger) as a contact charging member contacted to the photosensitive member 1, and it forms a charging nip n having a width of 3 mm relative to the photosensitive member 1, and is rotated in the direction opposite from the movement direction of the photosensitive member 1, namely, the clockwise direction indicated by the arrow at the speed of 500 rpm at the charging nip n. The charging brush 2 as the contact charging member is contacted to the photosensitive member 1 with a peripheral speed difference so as to rub the photosensitive member 1. It is supplied with a DC charging bias of −700V from the charging bias applying voltage source S1, by which the outer surface of the rotatable photosensitive member 1 is uniformly and directly charged substantially to −680V.

The charged surface of the rotatable photosensitive member 1 is exposed to scanning exposure L of laser beam which has been subjected to a strength modulation corresponding to time series electric digital pixel signals representative of an intended image information, the beam being emitted from a laser beam scanner 2 including laser diode and a polygonal mirror. By this, the electrostatic latent image is formed on the peripheral surface of the rotatable photosensitive member 1, corresponding to the image information.

The electrostatic latent image is then developed into a toner image by a reverse development device 4 using one-component magnetic insulative toner (negative charged toner) t in this example.

Designated by 4*a* is a non-magnetic developing sleeve as a developer carrying member having a diameter of 16 mm and containing a magnet 4*b*. The developing sleeve 4*a* is disposed spaced from the photosensitive member 1 by approx. 300 $\mu$m, and it is rotated at the same peripheral speed as the photosensitive member 1 codirectionally therewith in the developing zone (developing zone) a where the sleeve is opposed to the photosensitive member 1.

The rotatable developing sleeve 4*a* is coated with a thin layer of developer (toner) t by a regulating blade 4*c*. The layer thickness of the developer on the rotatable developing sleeve 4*a* is regulated by the regulating blade 4*c*, and developer is electrically charged by the regulating blade 4*c*. The developer on the rotatable developing sleeve 4*a* is carried to a developing zone a where the sleeve 4*a* is opposed to the photosensitive member 1, by rotation of the sleeve 4*a*. The sleeve 4*a* is supplied with a developing bias voltage from a developing bias applying voltage source S2. The developing bias voltage is in the form of a sum of a DC voltage of −500V and a rectangular pulse AC voltage having a peak-to-peak voltage of 1600V and a frequency of 1800 Hz.

Developer (toner) t is a known one comprising binder resin, magnetic particle and charge control material, and has been produced through kneading, pulverization and classification. In this example, the weight average particle size (D4) of the toner t is 7 $\mu$m.

On the other hand, a transfer material P as a recording material is fed from an unshown sheet feeding portion, and is introduced, at a predetermined timing, to a nip (transfer portion) b formed between the rotatable photosensitive member 1 and the intermediate resistance transfer roller 5 as the contact type transferring means contacted thereto at a predetermined urging force. The transfer roller 5 is supplied with a predetermined transfer bias voltage from a transfer bias application voltage source S3. In this example, the transfer roller 5 has a resistance value of $5\times10^8$ Ohm, and is supplied with a DC voltage of +2000V.

The transfer material P introduced into the transfer portion b passes through the nip, and receives the toner image from the surface of the rotatable photosensitive member 1 transferred thereto by the electrostatic force and the urging force.

The transfer material P now having the toner image, is separated from the surface of the photosensitive member 1, and is fed to a heat fixing type fixing device 6, where the toner image is fixed on the transfer material P. Finally, it is discharged as a print.

The surface of the photosensitive member 1 after the toner image transfer onto the transfer material P, is cleaned by a cleaning device 7 so that residual toner deposited contamination or the like is removed, and it is prepared for the next image formation.

Designated by 8 is a charge facilitator particle applying device for the surface of the photosensitive member 1, and functions to apply a predetermined amount of charge facilitator or promotion particles (charging assisting particles) m onto the surface of the photosensitive member 1 at a position between the cleaning device 7 ant the charging brush 2. The charge facilitator particles m applied on the surface of the photosensitive member 1 by the apparatus 8 are carried to a charge portion n where the charging brush 2 as the contact charging member is contacted to the photosensitive member 1, by the rotation of the photosensitive member 1, so that contact charging is carried out for the photosensitive member 1 by the charging brush 2 while the charge facilitator particles m are present at the charge portion n.

In the printer of this example, the photosensitive member 1, the charging brush 2, the developing device 4, the cleaning device 7 and the charge facilitator particle applying device 8 (five process means) are unified into a cartridge PC, which is detachably mountable to a main assembly of the printer (cartridge type). The combination of the process means contained in the process cartridge is not limited to those. However, it is preferably that cartridge contains at least one of the photosensitive member 1, the charging brush 2, the developing device 4 and the cleaning device 7. Designated by 9 is a guiding and holding members for the process cartridge PC at the time of mounting and demounting of the process cartridge relative to the main assembly. The present invention is not limitedly applicable to the cartridge type.

(2) a photosensitive member

Figure 2:
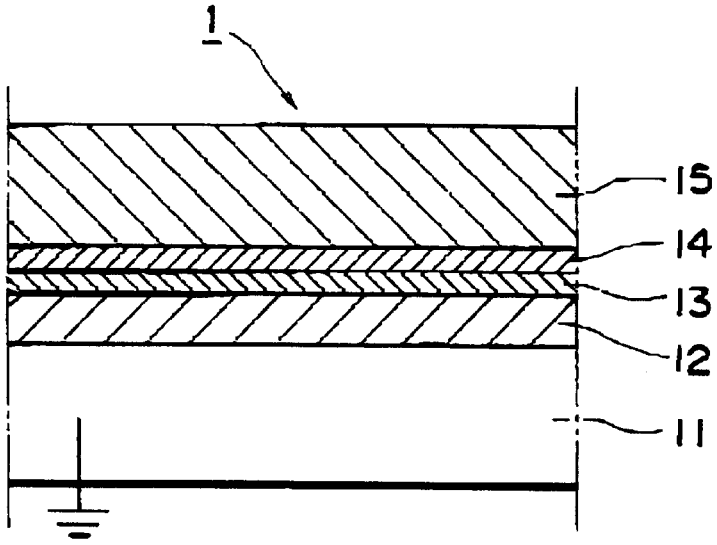
FIG. 2 is a schematic illustration of a layer structure of a photosensitive member used therein.

Referring to FIG. 2 which is an enlarged schematic section of a portion of the photosensitive member 1 provided with the charge injection layer employed in this embodiment, and depicts the laminar structure of the photosensitive member 1, the photosensitive member 1 in this embodiment, which is a negatively chargeable photosensitive member with organic photoconductor, is formed by coating the following first to fourth functional layers 12–15, in this order from the bottom, on a base member constituted of an aluminum cylinder (aluminum base) 11 with a diameter of 30 mm.

First layer 12: it is an undercoat layer constituted of an approximately 20 microns thick electrically conductive layer, and is coated to smooth out the defects of the aluminum base 11, and also to prevent the moire caused by the reflection of an exposure laser beam.

Second layer 13: it is a positive charge injection prevention layer, and plays a role in preventing the positive charge from the aluminum base 11 from canceling the negative charge given to the surface portion of the photosensitive member 1. It is an approximately 1 micron thick layer of Amylan, the electrical resistance of which has been adjusted to approximately $10^6$ Ohm.cm (medium resistance) with the use of methoxymethyl nylon.

Third layer 14: it is a charge generation layer constituted of an approximately 0.3 microns resin layer in which disazo pigment has been dispersed. It generates charge couples composed of a negative charge and a positive charge.

Fourth layer 15: it is a charge transfer layer composed of P-type semiconductor created by dispersing hydrazone in polycarbonate resin. Thus, the negative charge given to the surface portion of the photosensitive member 1 is not allowed to transfer through this layer, and only the positive charge generated in the charge generation layer is allowed to transfer to the outermost layer of the photosensitive member 1.

(3) charging brush 2

In this example, the contact charging member is a roller-like charging brush 2.

A tape 2*b* of pile fibers of electroconductive rayon fiber REC-B available from Yunichika KABUSHIKI KAISHA, Japan, is wound spirally around the core metal 2*a* having a diameter of 6 mm into a brush roller having an outer diameter of 14 mm at 300 denier/50 filament and at the density of 155 per 1 mm square. Resistance value of the brush is $1\times10^5$ Ohm with the applied voltage of 1–1000V. The resistance value was measured in this manner. It was contacted to a drum having a diameter of 30 mm with a nip width of 3 mm, and the voltage of 100V was applied, and the resistance was obtained on the basis of the current.

The resistance value of the charging brush 2 is preferably not less than $10^4$ Ohm from the standpoint of preventing image defect due to improper charging resulting from excess leak current through a pin hole or the like of the photosensitive member 1, and from the standpoint of sufficient charge injection, not more than $10^7$ Ohm is preferable.

The materials of the charging brush other then the REC-B, include REC-C, REC-M1, REC-M10 available from the same company, SA-7 available from Toray Kabushiki Kaisha, Japan, THUNDERLON available from Nippon Sanmo Kabushiki Kaisha, Japan, BELTLON available from Kanebo Kabushiki Kaisha, Japan, KURACARBO available from Kuraray KABUSHIKI KAISHA, Japan, a material obtained by dispersing carbon in rayon, LOPAL available from MITSUBISHI RAYON Kabushiki Kaisha, Japan, or the like. From the standpoint of stability against ambience, REC-B, REC-C, REC-M1, REC-M10 available from Yunichika KABUSHIKI KAISHA, is preferable.

In this example, the charging brush 2 is rotated at rotational frequency 500 rpm in such a direction that surface thereof moves counterdirectionally with respect to the photosensitive member surface at the nip formed therebetween. The rotational frequency is not limited to this example, but is determined properly by one skilled in the art in consideration of the width of the charging nip n between the charging brush 2 and the photosensitive member 1, density of the brush fibers, the surface resistance of the photosensitive member, process speed (peripheral speed) or the like.

The peripheral movement of the charging brush at the nip may be codirectional with that of the photosensitive member surface. However, since the charging property in the injection charging is dependent on the ratio of the peripheral speeds of the charging brush 2 and the photosensitive member 1, the counterdirectional peripheral movement arrangement is preferable, since otherwise the required rotational frequency of the charging brush 2 has to be higher than in the counterdirectional peripheral movement.

The peripheral speed ratio here is defined as follows:

Peripheral speed ratio(%)=((charging brush peripheral speed−photosensitive member peripheral speed)/photosensitive member peripheral speed)×100

Where the charging brush peripheral speed is positive when the direction of movement thereof is codirectional with the photosensitive member surface)

(4) charge facilitator particle m and charge injection charging

Figure 3:
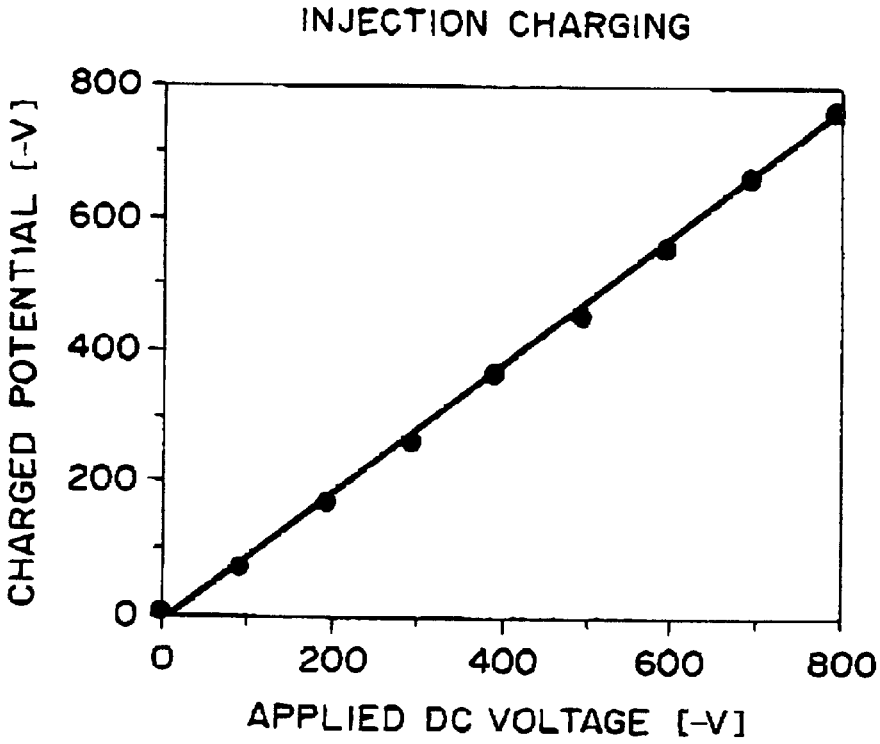
FIG. 3 is a graph showing a charging property in the charge injection charging.

In the charge injection charging, the direct charge injection is effected not through discharge phenomenon, using an intermediate resistance contact charging member. Therefore, even if the applied voltage to the contact charging member is lower than the charge starting threshold level, the photosensitive member can be charged to a potential corresponding to the applied voltage. FIG. 3 shows a relation between the applied DC voltage and the surface potential of the photosensitive member in this case.

Figure 8:
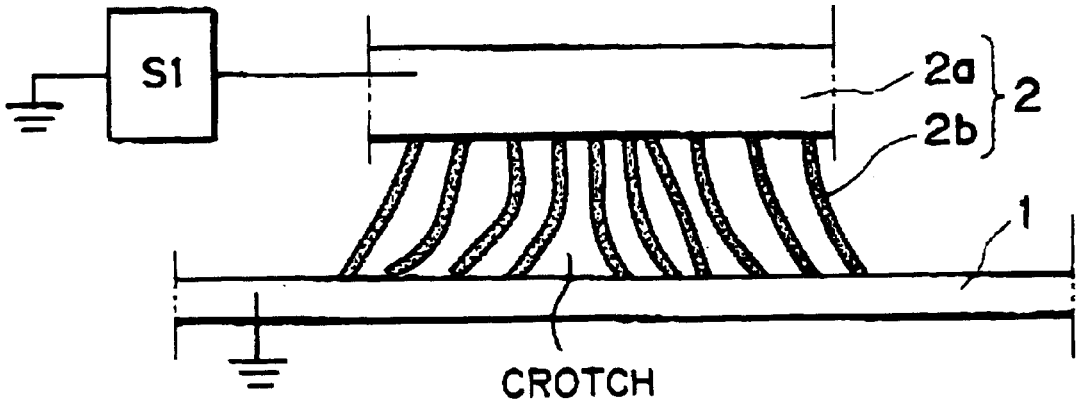
FIG. 8 shows a contact state between a charging brush and a photosensitive member.

The contact between the charging member and the surface of the photosensitive member is required to be sufficient. However, when the use is made with a charging brush as the contact charging member, there arises a problem that fiber ends of the charging brush branch as shown in FIG. 8 with the result of a zone where the brush does not contact the photosensitive member surface so that uniformity of charging is deteriorated, as has been discussed hereinbefore.

According to this embodiment, as shown in FIG. 1, there is provided an apparatus 8 for applying the charge facilitator particles m onto the surface of the photosensitive member 1 as the member to be charged , by which not less than $10^2$ particles/$mm^2$ of the charge facilitator particles m are applied onto the photosensitive member surface, and then, the problem was solved. The charge facilitator particle applying device 8 may use known means for applying particles, for example, the particles are uniformly applied on an application roller 8*a,* and thereafter, they are contacted to, or caused to jump at, the photosensitive member.

Figure 4:
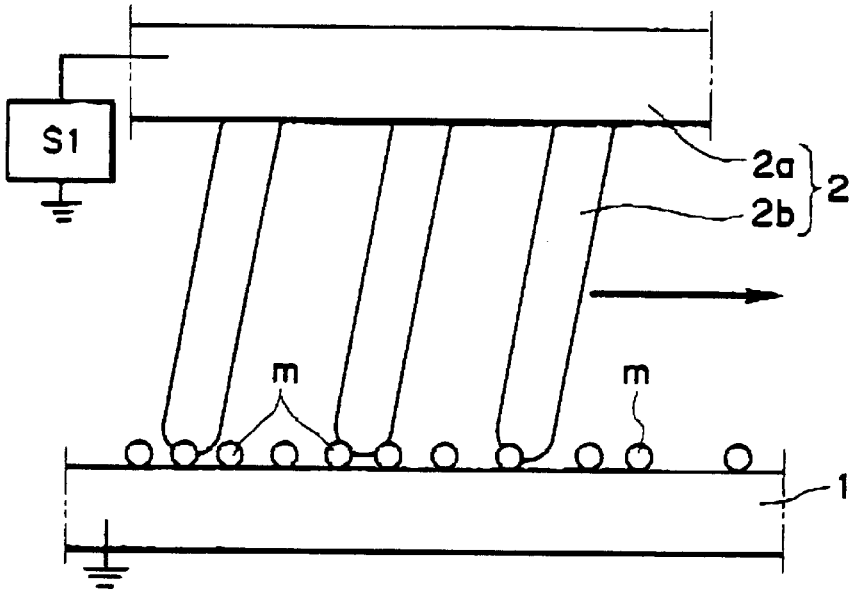
FIG. 4 is shows a model of contact state between a charging brush and a photosensitive member when charging facilitator or promotion particles are provided.

FIG. 4 show a model wherein the charge facilitator particles m improve the chances of contact of the charging member (here, the free end portion of the furbrush).

In this embodiment the preferably range of density of the applied charge facilitator particles is determined on the basis of a visual sense property of human being and on the basis of the experiments.

Recently, the recording resolution of laser beam printers is increasing from 300 dpi to, for example, 600 dpi. The charging has to be more uniform than this recording resolution.

Figure 5:
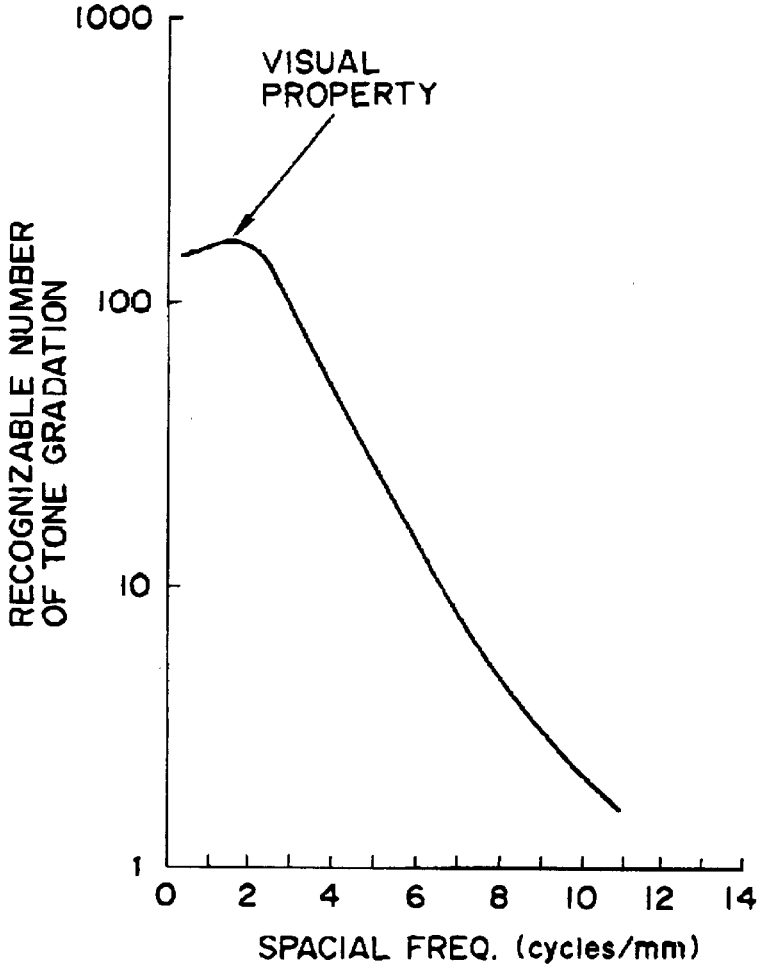
FIG. 5 shows a visual sense property of human being.

FIG. 5 shows a visual sense property of the human being, and it will be understood that when the spatial frequency is not less than 10 (cycles/mm), the number of discriminatable gradations on an image approaches limitlessly to 1, namely, it becomes impossible to discriminate a density non-uniformity.

By positively using this property, this embodiment presents the surface of the photosensitive member 1 with the charge facilitator particles m at a density not less than 10 (cycles/mm), and the contact injection charging is carried out with such distributed particles m.

Even if the improper charging occurs at a place not having the particles m, the density non-uniformity in the image resulting from the improper charging has the spatial frequency exceeding the visual sense property, and therefore, there is no practical problem.

Table 1 shows whether or not the improper charging is recognizable as a density non-uniformity in the image when the application density of the charge facilitator particles m is changed.

TABLE 1

| applied amount (particles /$mm^2$) | improvement in charging property | objective evaluation of image quality |
|---|---|---|
| 0 | No | NG |
| $10^1$ | Yes | NG |
| $10^2$ | Yes | F |
| $10^3$ | Yes | G |
| $10^4$ | Yes | G |
| $10^5$ | Yes | G |

G: No image defect is recognized.

F: Image defect is hardly recognized.

G: Image defect is recognizable.

The application density of the charge facilitator particles m was measured by observation through an optical or electron microscope.

As will be understood from Table, a small amount of charge facilitator particles m, for example, 10 particles/$mm^2$, applied on the photosensitive member 1, is enough to suppress the charging non-uniformity occurrence, but the result is not enough from the standpoint of tolerance for humans visual sense.

When, however, the amount is not less than $10^2/mm^2$, the results of relative evaluation is suddenly improved.

When it is not less than $10^3/mm^2$, the problem due to the improper charging disappears.

The charging by the contact injection type, as is essentially different from the discharging type, the assured contact of the charging member to the photosensitive member is desirable. But, even if the charge facilitator particles m are applied on the photosensitive member 1, no contact zone necessarily results. By positively using the visual sense property of the human being, the problem was solved.

The upper limit of the application amount of the particles m, is determined by the very uniform application on the photosensitive member 1, and the application beyond that does not provide any further improvement, and conversely, the particles may scatter or block the image exposure light.

The upper limit of the application density is different if the particle size of the particle m is different, but generally one complete layer on the photosensitive member 1 is the upper limit.

If the amount of the charging particle exceeds $5\times10^5$/mm$^2$, the particles are remarkably desorb to the photosensitive member 1 with the result of the exposure amount shortage of the photosensitive member 1 irrespective of the light transmissivity of the particle per se. If it is below $5\times10^5$ particle/mm$^2$, the amount of the charge facilitator particles 3 which depart from the photosensitive member 1 becomes moderate, and therefore, the harmful effect of the charge facilitator particles 3 is minimized. When the amount of the charge facilitator particles 3 which transferred onto the photosensitive member 1 while keeping the amount of the charge facilitator particles 3 between the charge roller 2 and the photosensitive member 1 in the above mentioned more desirable range was measured, it was within a range of $10^2$–$10^5$ particle/mm$^2$, which proves that desirable amount of the charge facilitator particles 3 placeable between the charge roller 2 and the photosensitive member 1 without harmfully affecting image formation is no more than $10^5$ particle/mm$^2$.

Next, the method used for measuring the amount of the charge facilitator particles 3 between the charge roller 2 and the photosensitive member 1, and the amount of the charge facilitator particles 3 on the photosensitive member 1, will be described. It is desirable that amount of the charge facilitator particles 3 between the charge roller 2 and the photosensitive member 1 is directly measured in the charging nip n between the charge roller 2 and the photosensitive member 1. However, the amount of the charge facilitator particles on the charge roller 2 measured immediately before the charging nip n is substituted for the actual amount of the charge facilitator particles between the charge roller 2 and the photosensitive member 1. More specifically, the rotation of the photosensitive member 1 and charge roller 2 is stopped, and the peripheral surfaces of the photosensitive member 1 and the charge roller 2 are photographed by a video-microscope (product of Olympus: OVM1000N) and a digital still recorder (product of Deltis: SR-3100), without applying the charge bias. In photographing the peripheral surface of the charge roller 2, the charge roller 2 is pressed against a piece of slide glass under the same condition as the charge roller 2 is pressed against the photosensitive member, and no less then 10 spots in the contact area between the charge roller 2 and the slide glass were photographed with the use of the video-microscope fitted with an object lens with a magnification power of 1,000. The thus obtained digital images are digitally processed using a predetermined threshold. Then, the number of cells in which a particle is present is calculated with the use of a designated image processing software. As for the amount of the charge facilitator particles on the photosensitive member 1, the peripheral surface of the photosensitive member 1 is photographed using the same video-microscope, and then, the obtained images are processed in the same manner to obtain the number of the charge facilitator particles on the photosensitive member 1.

The furbrush preferably has a high brush density, but the brush density used in this embodiment turned out to be enough. This is because what determines the charging points of the injection charging is mainly not the charging member, but the application density of the charge facilitator particles m, and therefore, the choice of the charging members is larger according to the embodiment.

The preferable particle size and property of the charge facilitator particles m are as follows:

The charge facilitator particles 3, which are in the nip between the charge roller 2 and the photosensitive member 1, is of electroconductive zinc oxide particles in this embodiment, but other materials, such as inorganic electroconductive particles, or mixture with organic material. In this embodiment, the average particle diameter of the particles, inclusive of the secondary particles formed through adhesion of primary particles, is 3 microns, and their specific resistivity is $10^6$ Ohm.cm.

The specific resistance of the charge facilitator particles 3 is desired to be no more than $10^{12}$ Ohm.cm, preferably, no more than $10^{10}$ Ohm.cm, since electrical charge is given or received through the charge facilitator particles 3. The specific resistance of the charge facilitator particles 3 is obtained using a tableting method. That is, first, a cylinder which measures 2.26 cm$^2$ in bottom area size is prepared. Then, 0.5 g of a material sample is placed in the cylinder, between the top and bottom electrodes, and the resistance of the material is measured by applying 100 V between the top and bottom electrodes while compacting the material between the top and bottom electrodes with a pressure of 15 kg. Thereafter, the specific resistivity of the sample material is calculated from the results of the measurement through normalization.

The uniform charging effect appears when the particle size is not more than 50 $\mu$m, but in view of the visual sense property of the human being, it is preferable that particle size is not more than approx. 5 $\mu$m, since then the influence of the improper charging portion to the image is hardly recognized visually.

The particle size of coagulated material of the particles is defined as an average particle size of the coagulated materials. As for the method of measuring the particle size, more than 100 particles are extracted using an optical or electron microscope, and the volume particle size distribution is calculated on the basis of a maximum arc distance in the horizontal direction, and the particle size is defined as the 50% average particle size.

The charge facilitator particles m may be in the form of primary particles or secondary particles. The state of coagulations is not material if they functions to promote the charging, but the particle density is of importance.

Figure 9:
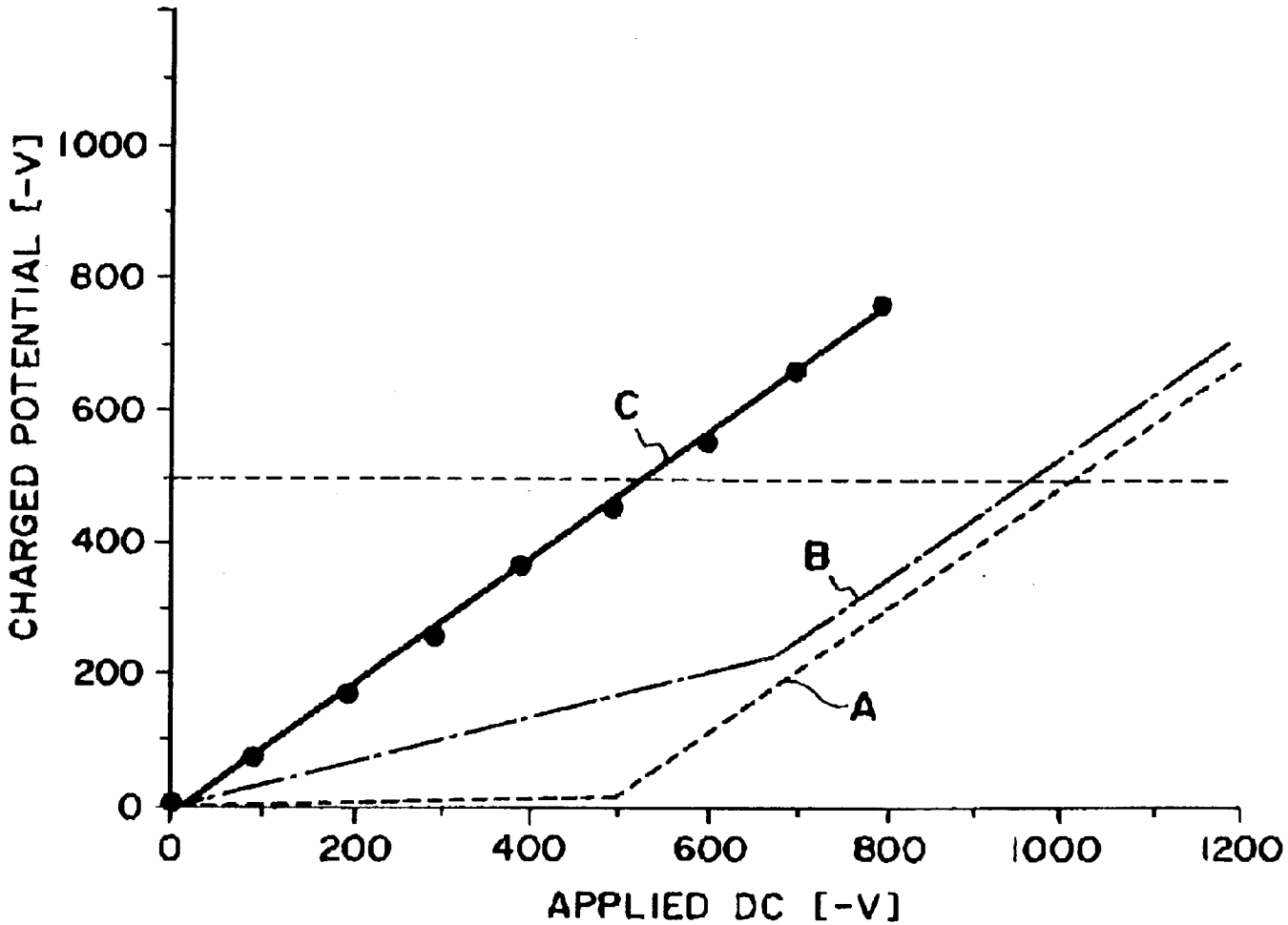
FIG. 9 is a charging property graph in the cases of a roller charging, a furbrush charging and a magnetic brush charging.

<Embodiment 2> (FIGS. 9–10)

Figure 6:
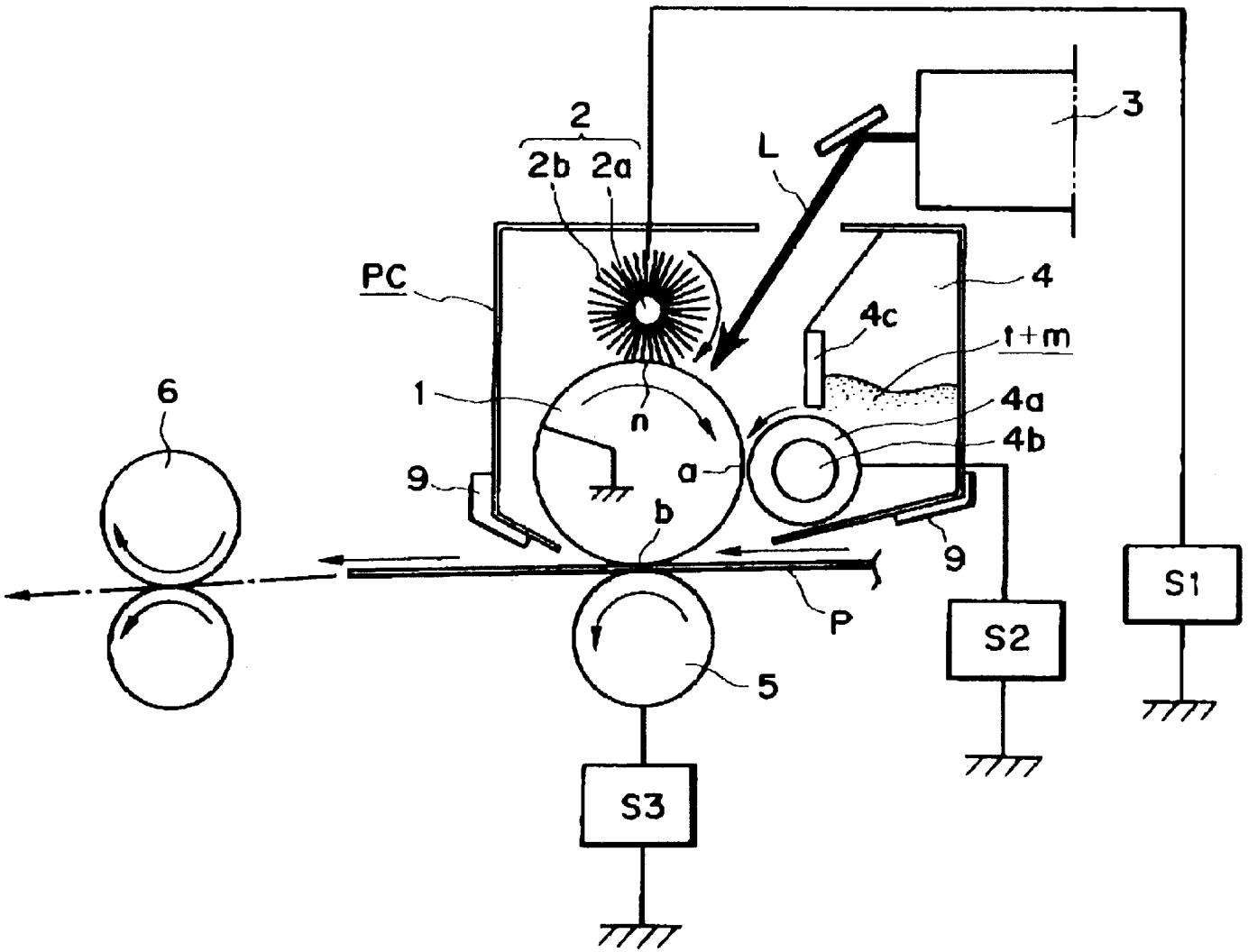
FIG. 6 is a schematic illustration of an image forming apparatus of Embodiment 2.

FIG. 6 shows a schematic illustration of an image forming apparatus according to an embodiment of the present invention. The exemplary image forming apparatus of this embodiment is a printer similar to the foregoing embodiment (FIG. 1), but the cleaning device 7 is omitted (cleanerless system), and the charge facilitator particle applying device 8 is omitted, and instead, the charge facilitator particles m were added to the developer (toner) powder t in the developing device 4, thus the developing device 4 functions also as the charge facilitator particle supply and applying means.

Toner t is a known one comprising binder resin, magnetic particle and charge control material, and has been produced through kneading, pulverization and classification, and the charge facilitator particles m are added to the toner powder. The weight average particle size (D4) of the toner t is 7 $\mu$m, and the particle size of the electroconductive zinc oxide particle as the charge facilitator particle m is 3 $\mu$m. The charge facilitator particle m is capable of functioning as fluidizing material for the toner t when the particle size of the charge facilitator particle m is not less than 10 nm and not more than toner particle size.

The content of the charge facilitator particles m relative to the toner t is generally 0.01–20 parts by weight relative to 100 parts by weight of the toner.

With the cleaner-less system, the untransferred toner remaining on the surface of the rotatable photosensitive member 1 after the toner image is transferred onto the transfer material P, is not removed by a cleaner, and therefore, the residual toner reaches the developing zone a through the charge portion n by the rotation of the photosensitive member 1. Then, it is removed and collected by the developing device 4 (simultaneous development and cleaning) (toner recycling process).

An amount of the charge facilitator particles m mixed in the developer t of the developing device 4 transfers onto the photosensitive member 1 together with the toner during the reverse development action of the developing device 4 for the electrostatic latent image on the photosensitive member 1.

The toner image on the photosensitive member 1 is positively transferred onto the transfer material P (recording material) by the transfer bias at he transfer portion b, but the charge facilitator particle m which is electroconductive does not positively transfer to the transfer material P, and remains deposited on the photosensitive member 1.

Since there is no cleaning device provided, the untransferred toner and the remaining charge facilitator particles m remaining on the surface of the photosensitive member 1 after the image transfer, are carried to the charge portion n where the charging brush 2 is in contact with the photosensitive member 1, by the movement of the surface of the photosensitive member 1. Therefore, the contact charging of the photosensitive member 1 is carried out with the charge facilitator particles m present at the contact area between the photosensitive member 1 and charging brush 2.

Some of the untransferred toner and the charge facilitator particles m pass through the charge portion n, and the untransferred toner and the charge facilitator particles m deposited and mixed into the charging brush 2, are gradually discharged to the photosensitive member 1 from the charging brush 2, and therefore, the surface of the photosensitive member 1 having the remaining toner is exposed with a laser beam for latent image formation. Then, the latent image formed surface having the remaining toner reaches the developing zone a with the movement of the surface of the photosensitive member 1, where is subjected to the simultaneous development and cleaning operation. More particularly, a cleaning electric field for transfer from the dark portion of the photosensitive member to the developing sleeve and the electric field for depositing the toner from the developing sleeve to the light portion of the photosensitive member, are formed.

In the case of the cleaner-less system, the charge facilitator particles m contained in the developer t of the developing device 4 transfers onto the surface of the photosensitive member 1 in the developing zone a upon the actuation of the apparatus, and are carried on the moving image carrying surface to the charge portion n through the transfer portion b so that fresh particles m are supplied to the charge portion n. Therefore, even if the amount of the charge facilitator particles m reduces, or the particles m are deteriorated, the charging property is maintained, and the charging property is stable. Since the charge facilitator particles applied on the photosensitive member are not removed by the cleaning device, a sufficient amount of the charge facilitator particles m always presents on the photosensitive member surface, so that charging property is drastically improved only by external addition of a small amount of facilitator particles m.

Naturally, the untransferred toner is also reused, thus permitting effective use of the toner.

At the initial stage of the printing operation, no charge facilitator particle is supplied to the contact portion n between the the charging brush 2 and the photosensitive member 1, and therefore, a proper amount of the charge facilitator particles are provided in the contact portion n.

Figure 7:
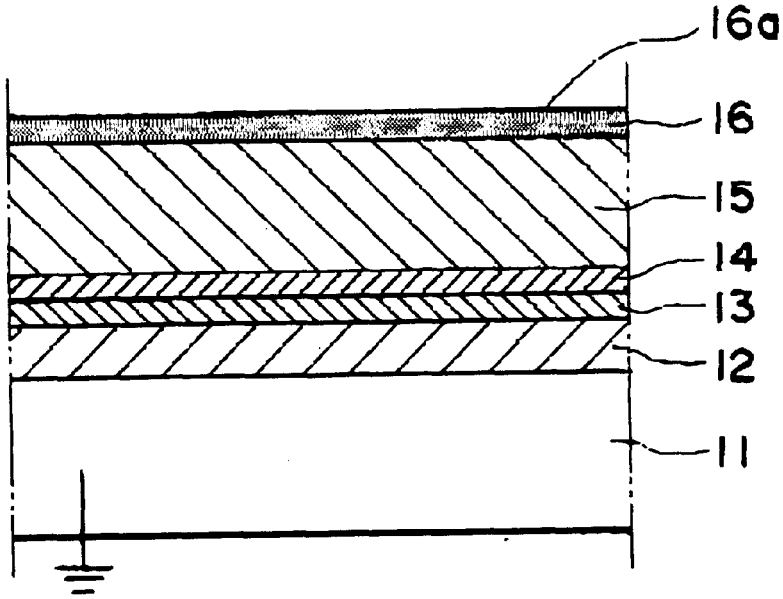
FIG. 7 is a schematic illustration of a layer structure of a photosensitive member used in an image forming apparatus of Embodiment 3.

<Embodiment 3> (FIG. 7)

In this embodiment, the apparatus of Embodiment 1 or 2 is modified such that resistance control is used for the surface layer of the photosensitive member 1 as the member to be charged.

In this embodiment, a charge injection layer is provided on the surface of the member to be charged so that resistance of the surface of the member to be charged is controlled to further stabilize the uniform charging.

FIG. 7 shows a schematic layer structure of the photosensitive member 1 having a surface charge injection layer. The photosensitive member 1 comprises an aluminum base 11, a primer layer 12, a positive charge injection preventing layer 13, a charge generating layer 14, a charge transfer layer 15 in this order (ordinary organic photosensitive member 1), as shown in FIG. 2, and further comprises a charge injection layer 16 thereon for improving the charging property.

The surface charge injection layer 16 has a resistance value which is lowered by dispersing $SnO_2$ ultra-fine electroconductive particles or the like as an electroconductive particles (electroconductive filler) in curable resin material such as photo-curing type acrylic resin material as a binder.

More particularly, 70 weight % of $SnO_2$ particles having a particle size approx. 0.03 microns having a resistance lowered by doping antimony is dispersed in the resin material, on the basis of the resin material, is applied on the surface.

The liquid thus prepared is applied by dip-coating into a thickness of 1 $\mu$m. Therefore, the resistance value is approx. $1\times10^{13}$ Ohm.cm. When the electroconductive particles are not dispersed, it was approx. $1\times10^{15}$ Ohm.cm. The measurements were carried out under the temperature of 25° C. and the humidity of 40%.

By using the photosensitive member having such a surface resistance value, good charging properties are provided.

The resistance of the surface layer is important from the standpoint of function of the charge injection layer 16. In the charging system using the direct injection of the charge, the charge is efficiently moved if the resistance of the member to be charged is lowered. On the other hand, from the standpoint of the function of the photosensitive member, it is required to keep the electrostatic latent image for a predetermined period of time, and therefore, the volume resistivity of the charge injection layer 16 is preferably $1\times10^{9}$–$1\times10^{14}$ (Ohm.cm).

In the case of not using the charge injection layer 16 as in this embodiment, the equivalent effects are provided if the charge transfer layer 15 has the resistance in the above range.

The same advantages are provided when the use is made with an amorphous silicon photosensitive member or the like having a volume resistivity of approx. $10^{13}$ Ohm.cm.

By the use of the photosensitive member 1 subjected to the resistance control at the surface layer, the electrostatic latent image is properly maintained, and a sufficient charging property is provided even in the case of the high process speed, thus improving the direct charging system.

Others

1) The charge facilitator particle supplying and applying means 4 for the member to be charged 1 or the contact charging member 2 is not lifted to those described in the foregoing, and as an alternative arrangement, a foam or furbrush containing the charge facilitator particle m may be contacted to the member to be charged 1 or the contact charging member 2.

2) the contact charging member 2 may be in the form of a felt, textile or the like. Or, they may be laminated to provide proper elasticity and/or electroconductivity. It may be in the form of a charging roller.

The charge bias applied to a contact type charging member or the development bias applied to a development sleeve may be compound voltage composed of DC voltage and an alternative voltage (AC voltage).

The waveform of the alternating voltage is optional; the alternating wave may be in the form of a sine wave, a rectangular wave, a triangular wave, or the like. Also, the alternating current may be constituted of an alternating current in the rectangular form which is generated by periodically turning on and off a DC power source. In other words, the waveform of the alternating voltage applied, as the charge bias, to a charging member or a development member may be optional as long as the voltage value periodically changes.

4) The choice of the means for exposing the surface of an image bearing member to form an electrostatic latent image does not need to be limited to the laser based digital exposing means described in the preceding embodiments. It may be an ordinary analog exposing means, a light emitting element such as a LED, or a combination of a light emitting element such as a fluorescent light and a liquid crystal shutter. In other words, it does not matter as long as it can form an electrostatic latent image correspondent to the optical information of a target image.

An image bearing member may be constituted of a dielectric member with an electrostatic recording faculty. In the case of such a dielectric member, the surface of the dielectric member is uniformly charged to a predetermined polarity and a predetermined potential level (primary charge), and then, the charge given to the surface of the dielectric member is selectively removed with the use of a charge removing means such as a charge removing needle head or an electron gun to write, or form, the electrostatic latent image of a target image on the surface.

5) in the embodiments, the developing device 4 has been described as a one-component type non-contact type developing device using a magnetic developer, but a non-contact type developing device using a two component developer or a non-magnetic developer, is usable. It may be a one-component type or two component type contact type developing device.

6) the recording material which receives the toner image from the photosensitive member 1 may be an intermediary transfer member such as a transfer drum.

One example of a method for measuring the size of toner particles is as follows. A measuring apparatus is a Coulter counter TA-2 (product of Coulter Co., Ltd.) To this apparatus, an interface (product of NIPPON KAGAKU SEIKI) through which the values of the average diameter distribution and average volume distribution of the toner particles are outputted, and a personal computer (Canon CX-1), are connected. The electrolytic solution is 1% water solution of NaCl (first class sodium chloride).

In measuring, 0.1–5 ml of surfactant, which is desirably constituted of alkylbenzene sulfonate, is added as dispersant in 100–150 ml of the aforementioned electrolytic solution, and then, 0.5–50 mg of the toner particles are added.

Next, the electrolytic solution in which the toner particles are suspended is processed approximately 1–3 minutes by an ultrasonic dispersing device. Then, the distribution of the toner particles measuring 2–40 microns in particle size is measured with the use of the aforementioned Coulter counter TA-2, the aperture of which is set at 100 microns, and the volumetric average distribution of the toner particles is obtained. Finally, the volumetric average particle size of the toner particles is calculated from the thus obtained volumetric average distribution of the toner particles.

While the invention has been described with reference to the structures disclosed herein, it is not confined to the details set forth and this application is intended to cover such modifications or changes as may come within the purposes of the improvements or the scope of the following claims.

What is claimed is:

1. A charging device comprising:

a charging member to which a voltage is applicable to charge a member to be charged, said charging member including a flexible member for forming a nip with said member to be charged, wherein said flexible member is moved to provide a speed difference between a surface of said member to be charged and a surface of said flexible member;

wherein not less than $10^2/mm^2$ electroconductive particles are provided in said nip.

2. A device according to claim 1, wherein a volume resistivity of said electroconductive particles is not more than $1\times10^{12}$ Ohm.cm.

3. A device according to claim 1, wherein a volume resistivity of said electroconductive particles is not more than $1\times10^{10}$ Ohm.cm.

4. A device according to claim 1, wherein said electroconductive particle is non-magnetic.

5. A device according to claim 1, wherein a particle size of said electroconductive particle is not more than 5 $\mu$m.

6. A device according to claim 1, wherein a particle size of said electroconductive particle is not less than 20 nm.

7. A device according to claim 1, wherein said charging member is so disposed that movement direction of said flexible member and a movement direction of said member to be charged are opposite from each other in said nip.

8. A device according to claim 1, wherein said flexible member is an elastic member.

9. A device according to claim 1, further comprising supply means for supplying said electroconductive particles to said member to be charged.

10. A device according to claim 1, wherein said flexible member is in the form of a fiber brush.

11. A device according to any one claims 1–10, wherein said charging member effects injection charging for said member to be charged at said nip.

12. A charging method comprising the steps of:

providing a charging member to which a voltage is applicable to charge a member to be charged, wherein said charging member includes a flexible member for forming a nip with said member to be charged;

providing not less than $10^2/mm^2$ electroconductive particles in said nip; and moving said flexible member to provide a speed difference between a surface of said member to be charged and a surface of said flexible member.

13. A method according to claim 12, wherein a volume resistivity of said electroconductive particles is not more than $1\times10^{12}$ Ohm.cm.

14. A method according to claim 12, wherein a volume resistivity of said electroconductive particles is not more than $1\times10^{12}$ Ohm.cm.

15. A method according to claim 12, wherein said electroconductive particle is non-magnetic.

16. A method according to claim 12, wherein a particle size of said electroconductive particle is not more than 5 $\mu$m.

17. A method according to claim 12, wherein a particle size of said electroconductive particle is not less than 20 nm.

18. A method according to claim 12, wherein said charging member is so disposed that movement direction of said flexible member and a movement direction of said member to be charged are opposite from each other in said nip.

19. A method according to claim 12, wherein said flexible member is an elastic member.

20. A method according to claim 12, wherein said flexible member is in the form of a fiber brush.

21. A method according to any one of claims 12–20, wherein said charging member effects injection charging for said member to be charged at said nip.

22. A process cartridge detachably mountable to an image forming apparatus, comprising:

a member to be charged capable of carrying an image;

a charging member to which a voltage is applicable to charge a member to be charged, said charging member including a flexible member for forming a nip with said member to be charged, wherein said flexible member is moved to provide a speed difference between a surface of said member to be charged and a surface of said flexible member; wherein not less than $10^2/mm^2$ electroconductive particles are provided in said nip.

23. A process cartridge according to claim 22, wherein a volume resistivity of said electroconductive particles is not more than $1\times10^{12}$ Ohm.cm.

24. A process cartridge according to claim 22, wherein a volume resistivity of said electroconductive particles is not more than $1\times10^{12}$ Ohm.cm.

25. A process cartridge according to claim 22, wherein said electroconductive particle is non-magnetic.

26. A process cartridge according to claim 22, wherein a particle size of said electroconductive particle is not more than 5 $\mu$m.

27. A process cartridge according to claim 22, wherein a particle size of said electroconductive particle is not less than 20 nm.

28. A process cartridge according to claim 22, wherein said charging member is so disposed that movement direction of said flexible member and a movement direction of said member to be charged are opposite from each other in said nip.

29. A process cartridge according to claim 22, wherein said flexible member is an elastic member.

30. A process cartridge according to claim 22, further comprising supply means for supplying said electroconductive particles to said member to be charged.

31. A process cartridge according to claim 22, wherein said flexible member is in the form of a fiber brush.

32. A process cartridge according to any one claims 22–31, wherein said charging means effects injection charging for said member to be charged at said nip.

33. A process cartridge according to claim 22, wherein said member to be charged is provided with a surface layer having a volume resistivity of not more than $1\times10^{14}$ Ohm.cm.

34. A process cartridge according to claim 33, wherein said surface layer has a volume resistivity of not less than $1\times10^{9}$ Ohm.cm.

35. A process cartridge according to claim 34, wherein said member to be charged is provided with an electrophotographic photosensitive layer inside said surface layer.

36. An image forming apparatus comprising:

a member to be charged capable of carrying an image;

a charging member to which a voltage is applicable to charge a member to be charged, said charging member including a flexible member for forming a nip with said member to be charged, wherein said flexible member is moved to provide a speed difference between a surface of said member to be charged and a surface of said flexible member; wherein not less than $10^2/mm^2$ electroconductive particles are provided in said nip.

37. An apparatus according to claim 36, wherein a volume resistivity of said electroconductive particles is not more than $1\times10^{12}$ Ohm.cm.

38. An apparatus according to claim 36, wherein a volume resistivity of said electroconductive particles is not more than $1\times10^{10}$ Ohm.cm.

39. An apparatus according to claim 36, wherein said electroconductive particle is non-magnetic.

40. An apparatus according to claim 36, wherein a particle size of said electroconductive particle is not more than 5 $\mu$m.

41. An apparatus according to claim 36, wherein a particle size of said electroconductive particle is not less than 20 nm.

42. An apparatus according to claim 36, wherein said charging member is so disposed that movement direction of said flexible member and a movement direction of said member to be charged are opposite from each other in said nip.

43. An apparatus according to claim 36, wherein said flexible member is an elastic member.

44. An apparatus according to claim 36, further comprising supply means for supplying said electroconductive particles to said member to be charged.

45. An apparatus according to claim 36, wherein said flexible member is in the form of a fiber brush.

46. An apparatus according to any one claims 36–45, wherein said charging member effects injection charging for said member to be charged at said nip.

47. An apparatus according to claim 36, wherein said member to be charged is provided with a surface layer having a volume resistivity of not more than $1\times10^{14}$ Ohm.cm.

48. An apparatus according to claim 47, wherein said surface layer has a volume resistivity of not less than $1\times10^{9}$ Ohm.cm.

49. An apparatus according to claim 48, wherein said member to be charged is provided with an electrophotographic photosensitive layer inside said surface layer.

50. An apparatus according to claim 36, wherein said image forming means includes developing means for developing an electrostatic latent image formed on said member to be charged with toner, and developing means is capable of removing residual toner from said member to be charged.

51. An apparatus according to claim 50, wherein said developing means is capable of effecting a cleaning operation while effecting a developing operation.

* * * * *

UNITED STATES PATENT AND TRADEMARK OFFICE

CERTIFICATE OF CORRECTION

PATENT NO. : 6,081,681
DATED : June 27, 2000
INVENTOR(S) : Nagase et al.

It is certified that error appears in the above-identified patent and that said Letters Patent is hereby corrected as shown below:

Delete title page and columns 1-20 and substitute therefore the attached title page and columns 1-20 as shown.

Signed and Sealed this

Twentieth Day of July, 2004

JON W. DUDAS
*Acting Director of the United States Patent and Trademark Office*

United States Patent [19]

Nagase et al.

[11] Patent Number: 6,081,681

[45] Date of Patent: Jun. 27, 2000

[54] CHARGING DEVICE, CHARGING METHOD, PROCESS CARTRIDGE AND IMAGE FORMING APPARATUS

[75] Inventors: Yukio Nagase, Shizuoka; Harumi Ishiyama, Numazu; Yasunori Chigono, Susono; Jun Hirabayashi, Numazu, all of Japan

[73] Assignee: Canon Kabushiki Kaisha, Tokyo, Japan

[21] Appl. No.: 09/035,108

[22] Filed: Mar. 5, 1998

[30] Foreign Application Priority Data

Mar. 5. 1997 [JP] Japan ..... 9-067423

[51] Int. Cl.[7] ..... G03G 15/02

[52] U.S. Cl. ..... 399/174; 399/175; 430/902

[58] Field of Search ..... 399/174, 175, 399/176; 430/902

[56] References Cited

U.S. PATENT DOCUMENTS

| | | | |
|---|---|---|---|
| 5,177,537 | 1/1993 | Okano et al. | 355/259 |
| 5,241,342 | 8/1993 | Asano et al. | 399/175 |
| 5,678,136 | 10/1997 | Watanabe et al. | 399/100 |
| 5,682,585 | 10/1997 | Yamaguchi et al. | 399/274 |

FOREIGN PATENT DOCUMENTS

| | | |
|---|---|---|
| 7-152222 | 6/1995 | Japan . |

*Primary Examiner*—Joan Pendegrass

*Attorney, Agent, or Firm*—Fitzpatrick, Cella, Harper & Scinto

[57] ABSTRACT

The invention is directed to a charging device which includes a charging member to which a voltage is applied to charge a member to be charged. The charging member includes a flexible member for forming a nip containing electroconductive particles in an amount not less than $10^2/mm^2$, with the member to be charged. The surface of the flexible member moves relative to the surface of the member to be charged to provide a difference in speed between them.

51 Claims, 6 Drawing Sheets

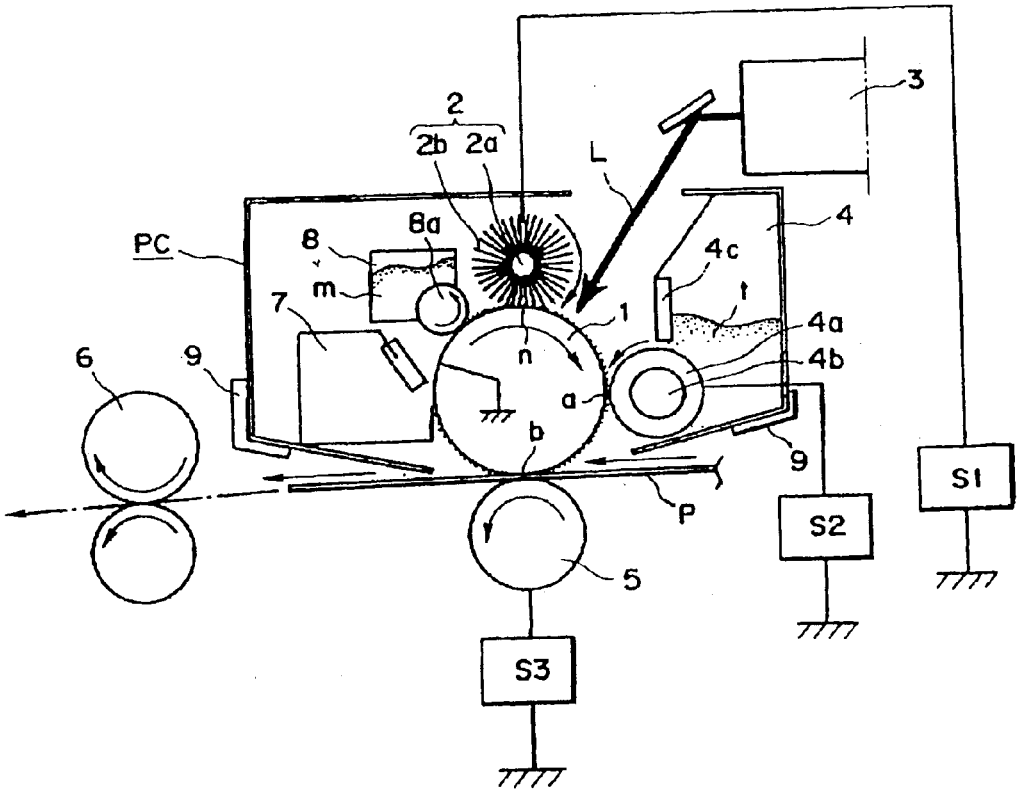

CHARGING DEVICE, CHARGING METHOD, PROCESS CARTRIDGE AND IMAGE FORMING APPARATUS

FIELD OF THE INVENTION AND RELATED ART

The present invention relates to a charging device, a charging method, a process cartridge and an image forming apparatus, wherein a member to be charged, such as an image bearing member, is electrically charged by electroconductive particles.

A corona type charger (corona discharging device) has been widely used as a charging apparatus for charging (inclusive of discharging) an image bearing member (object to be charged), such as an electrophotographic photosensitive member or an electrostatic dielectric recording member, to a predetermined polarity and a predetermined potential level in image forming apparatuses which include, for example, an electrophotographic apparatus (copying machine, printer, or the like) or an electrostatic recording apparatus.

The corona type charging device is a non-contact type charging device, which includes a corona discharging electrode (such as a wire electrode), surrounded by a shield electrode. The corona type charging device is positioned so that a corona discharging opening faces an image bearing member, that is, an object to be charged. In usage, the surface of an image bearing member is charged to a predetermined potential level by being exposed to discharge current (a corona shower) generated when high voltage is applied between the corona discharging electrode and the shield electrode.

Recently, it has been proposed to employ a contact type charging apparatus for charging the image bearing member, in an image forming apparatus of low to medium speed. This has been proposed since a contact type charging apparatus has an advantage over a corona type charging apparatus in terms of low ozone production, low power consumption, and the like. Such contact type charging apparatuses have been put to practical use.

In order to charge an object such as an image bearing member using a contact type charging apparatus, the electrically conductive charging member (contact type charging member, contact type charging device, and the like) of a contact type apparatus is placed in contact with the object to be charged, and an electrical bias (charge bias) of a predetermined level is applied to the contact type charging member so that surface of the object to be charged is charged to a predetermined polarity and a predetermined potential level. The charging member is available in various forms, for example, as a roller type (charge roller), a fur brush type, a magnetic brush type, a blade type, and the like.

When an object is electrically charged by a contact type charging member, two types of charging mechanisms (or charging principles) come into action: (1) a mechanism which discharges electrical charge, and (2) a mechanism for injecting charge. Thus, the characteristics of each contact type charging apparatus or principle is determined by which of the above charging mechanisms is dominant in charging the object.

(1) Electrical discharge based charging mechanism

In this charging mechanism, the surface of an object to be charged is charged by electrical discharge which occurs across a microscopic gap between a contact type charging member and the object to be charged.

In the case of the electrical discharge based charging mechanism, there is a threshold voltage which must be surpassed by the charge bias applied to a contact type charging member before electrical discharge occurs between a contact type charging member and an object to be charged. In order for an object to be charged through the electrical discharge based charging mechanism, it is necessary to apply to the contact type charging member a voltage with a value greater than the value of the potential level to which the object is to be charged. Thus, in principle, when the electrical discharge based charging mechanism is in action, the discharge product is unavoidable, that is, active ions such as ozone ions are produced, even though the amount thereof is remarkably small.

(2) Direct charge injection mechanism

This is a mechanism in which the surface of an object to be charged is charged by directly injecting an electrical charge into the object to be charged, with a contact type charging member. Thus, this mechanism is called a "direct charging mechanism", or a "charge injection mechanism". More specifically, a contact type charging member with medium electrical resistance is placed in contact with the surface of an object to be charged to directly inject electrical charge into the surface portion of the object to be charged, without relying on electrical discharge, or, in other words, without using electrical discharge in principle. Therefore, even if the value of the voltage applied to a contact type charging member is below the discharge starting voltage value, the object to be charged can be charged to a voltage level which is substantially the same as the level of the voltage applied to the contact type charging member.

This direct injection charging mechanism does not suffer from the problems caused by the by-product of electrical discharge since it is not accompanied by ozone production. However, in the case of this charging mechanism, the state of the contact between a contact type charging member and an object to be charged greatly affects the manner in which the object is charged since this charging mechanism directly charges an object. Thus, a direct injection charging mechanism should comprise a contact type charging member composed of high density material, and also should be given a structure which provides a large speed difference between the charging member and the object to be charged, so that a given point on the surface of the object to be charged makes contact with a larger area of the charging member.

A) Charging apparatus with charge roller

In the case of a contact type charging apparatus, a roller charge system, that is, a charging system which employs an electrically conductive roller (charge roller) as a contact type charging member, is widely used because of its desirability in terms of safety.

As for the charging mechanism in this roller charge system, the aforementioned (1) charging mechanism, which discharges electrical charge, is dominant.

Charge rollers are formed of rubber or foam material with substantial electrical conductivity, or electrical resistance, of a medium level. In some charge rollers, the rubber or foam material is layered to obtain a specific characteristic.

In order to maintain stable contact between a charge roller and an object to be charged (hereinafter, "photosensitive member"), a charge roller is given elasticity, which in turn increases frictional resistance between the charge roller and the photosensitive member. In many cases, a charge roller is rotated by the rotation of the photosensitive drum, or is individually driven at a speed slightly different from that of the photosensitive drum. As a result, the following problems occur: absolute charging performance declines, the state of the contact between the charge roller and the photosensitive drum becomes less desirable, and foreign matter adheres to the charge roller and/or the photosensitive member. With a conventional charging roller, the dominant charging mechanism through which a roller charging member charges an object is a corona charging mechanism.

FIG. 9 is a graph which shows an example of efficiency in contact type charging. In the graph, the abscissas represents the bias applied to a contact type charging member, and the ordinate axis represents the potential levels correspondent to the voltage values of the bias applied to the contact type charging member. The characteristics of the charging by a roller are represented by a line designated by a character A. According to this line, when a charge roller is used to charge an object, the charging of the object occurs in a voltage range above an electric discharge threshold value of approximately −500 V. Therefore, generally, in order to charge an object to a potential level of −500 V with the use of a charge roller, either a DC voltage of −1,000 V is applied to the charge roller, or an AC voltage with a peak-to-peak voltage of 1,200 V, in addition to a DC voltage of −500 V, is applied to the charge roller to keep the difference in potential level between the charge roller and the object to be charged at a value greater than the electric discharge threshold value, so that the potential of the photosensitive drum converges to the desired potential level.

More specifically, in order to charge a photosensitive drum with a 25 microns thick organic photoconductor layer by pressing a charge roller upon the photosensitive member, charge bias with a voltage value of approximately 640 V or higher should be applied to the charge roller. Where the value of the charge bias is approximately 640 V or higher, the potential level at the surface of the photosensitive member is proportional to the level of the voltage applied to the charge roller, since the relationship between the potential level and the voltage applied to the charge roller is linear. This threshold voltage is defined as a charge start voltage $V_{th}$.

In other words, in order to charge the surface of a photosensitive member to a potential level of $V_d$ which is necessary for electrophotography, a DC voltage of $(V_d+V_{th})$, which is higher than the voltage level to which the photosensitive member is to be charged, is necessary. Hereinafter, the above described charging method in which only DC voltage is applied to a contact type charging member to charge an object will be called "DC charging method".

However, with the use of the DC charging method, it is difficult to bring the potential level of a photosensitive member exactly to a target level, since the resistance value of a contact charging member changed due to changes in ambience or the like, and also the threshold voltage $V_{th}$ changed as the photosensitive member was shaved away.

As for a counter measure for the above described problem, Japanese Laid-Open Patent Application No. 149,669/1988 discloses an invention which deals with the above problem to effect more uniform changing of a photosensitive member. According to this invention, an "AC charging method" is employed, in which a compound voltage composed of a DC component equivalent to a desired potential $V_d$, and an AC component with a peak-to-peak voltage which is twice the threshold voltage $V_{th}$, is applied to a contact type charging member. This is intended to utilize the averaging effect of alternating current. That is, the potential of an object to be charged is caused to converge to the $V_d$, the center of the peaks of the AC voltage, without being affected by external factors such as operational ambience.

However, even in the case of the contact type charging apparatus in the above described invention, the principal charging mechanism uses electrical discharge from a contact type charging member to a photosensitive member. Therefore, as already described, the voltage applied to the contact type charging member needs to have a voltage level higher than the voltage level to which the photosensitive member is to be charged. Thus, ozone is generated, although only in a small amount.

Further, when AC current is used so that an object is uniformly charged due to the averaging effect of AC current, the problems related to AC voltage become more conspicuous. For example, more ozone is generated, noises traceable to the vibration of the contact type charging member and the photosensitive drum caused by the electric field of AC voltage increase, and the deterioration of the photosensitive member surface caused by electrical discharge increases, which add to the prior problems.

B) Charging apparatus with a fur brush

In the case of this charging apparatus, a charging member (fur brush type charging device) with a brush portion composed of electrically conductive fiber is employed as the contact type charging member. The brush portion, composed of electrically conductive fiber, is placed in contact with a photosensitive member as an object to be charged, and a predetermined charge bias is applied to the charging member to charge the peripheral surface of the photosensitive member to a predetermined polarity and a predetermined potential level.

Also, in the case of a charging apparatus with a fur brush, the dominant charging mechanism is the electrical discharge based charging mechanism.

It is known that there are two types of fur brush type charging devices: a fixed type and a roller type. In the case of the fixed type, fiber with medium electrical resistance is woven into a foundation cloth to form a pile, and a piece of this pile is adhered to an electrode. In the case of the rotatable type, the pile is wrapped around a metallic core. In terms of fiber density, pile with a density of 100 fibers/mm$^2$ can be relatively easily obtained, but the density of 100 fibers/mm$^2$ is not sufficient to create a state of contact which is satisfactory to charge an object by charge injection. Further, in order to give a photosensitive member a satisfactory uniform charge by charge injection, velocity difference, which is almost impossible to attain with the use of a mechanical structure, must be established between a photosensitive drum and a roller type fur brush. Therefore, the fur brush type charging device is not practical.

The relationship between the DC voltage applied to a fur brush type charging member and the potential level to which a photosensitive member is charged by the DC voltage applied to the fur brush, shows a characteristic represented by a line B in FIG. 5. As is evident from the graph (also in the case of the contact type charging apparatus which comprises a fur brush) whether the fur brush is of the fixed type or the roller type, the photosensitive member is charged mainly through electrical discharge triggered by applying to the fur brush a charge bias, the voltage level of which is higher than the potential level desired for the photosensitive member.

C) Magnetic brush type charging apparatus

A charging apparatus of this type comprises a magnetic brush portion (magnetic brush based charging device) as the contact type charging member. A magnetic brush consists of electrically conductive magnetic particles magnetically confined in the form of a brush by a magnetic roller or the like. This magnetic brush portion is placed in contact with a photosensitive member as an object to be charged, and a predetermined charge bias is applied to the magnetic brush to charge the peripheral surface of the photosensitive member to a predetermined polarity and a predetermined potential level.

In the case of this magnetic brush type charging apparatus, the dominant charging mechanism is the charge injection mechanism (2).

As for the material for the magnetic brush portion, electrically conductive magnetic particles, the diameters of which are in a range of 5–50 microns, are used. With the provision of sufficient difference in peripheral velocity between a photosensitive drum and a magnetic brush, the photosensitive member can be uniformly charged through charge injection.

In the case of a magnetic brush type charging apparatus, the photosensitive member is charged to a potential level which is substantially equal to the voltage level of the bias applied to the contact type charging member, as shown by a line C in FIG. 9.

However, a magnetic brush type charging apparatus also has its own problems. For example, it is complicated in structure. Also, the electrically conductive magnetic particles which constitute the magnetic brush portion become separated from the magnetic brush and adhere to a photosensitive member.

Japanese Patent Publication Application No. 3,921/1994 discloses a contact type charging method, according to which a photosensitive member is charged by injecting electric charge into the charge injectable surface layer thereof, more specifically into the traps or electrically conductive particles in the charge injectable surface layer. Since this method does not rely on electrical discharge, the voltage level necessary to charge the photosensitive member to a predetermined potential level is substantially the same as the potential level to which the photosensitive member is to be charged, and in addition, no ozone is generated. Further, since AC voltage is not applied, there is no noise traceable to the application of AC voltage. In other words, a magnetic brush type charging system is an excellent charging system superior to the roller type charging system in terms of ozone generation and power consumption, since it does not generate ozone, and uses far less power compared to the roller type charging system.

D) Toner recycling process (cleanerless system)

In a transfer type image forming apparatus, the toner which remains on the peripheral surface of a photosensitive member (image bearing member) after image transfer is removed by a cleaner (cleaning apparatus) and becomes waste toner. Not only for obvious reasons, but also for environmental protection as well, it is desirable that waste toner is not produced. Thus, image forming apparatuses capable of recycling toner have been developed. In such an image forming apparatus, cleaner is eliminated, and the toner which remains on the photosensitive member after image transfer is removed from the photosensitive drum by a developing apparatus. The residual toner on the photosensitive member is recovered by a developing apparatus at the same time as a latent image on the photosensitive drum is developed by the developing apparatus, and then is reused for development.

More specifically, the toner which remains on a photosensitive member after image transfer is recovered by fog removal bias (voltage level difference $V_{back}$ between the level of the DC voltage applied to a developing apparatus and the level of the surface potential of a photosensitive member) during the following image transfer. According to this cleaning method, the residual toner is recovered by the developing apparatus and is used for the following image development and thereafter. Thus, the waste toner is eliminated, and the labor spent for maintenance is reduced. Furthermore, being cleanerless is quite advantageous in terms of space, allowing image forming apparatuses to be substantially reduced in size.

E) Coating of contact type charging member with electrically conductive powder

Japanese Laid-Open Patent Application No. 103,878/1991 discloses a contact type charging apparatus with a structure that coats a contact type charging member with electrically conductive powder, on the surface which comes in contact with the surface of an object to be charged, so that surface of the object to be charged is uniformly charged, that is, without irregularity in charge. The contact type charging member in this charging apparatus is rotated by the rotation of the object to be charged, and the amount of ozone generated by this charging apparatus is remarkably small compared to the amount of ozonic products generated by a corona type charging apparatus such as scorotron. However, even in the case of this charging apparatus, the principle on which an object is charged is the same as the principle on which an object is charged by the aforementioned charge roller. In other words, an object is charged by electrical discharge. Furthermore, also in the case of this charging apparatus, in order to assure that an object to be charged is uniformly charged, compound voltage composed of a DC component and an AC component is applied to the contact type charging member, and therefore, the amount of ozonic products traceable to electrical discharge becomes relatively large. Thus, even this contact type charging apparatus is liable to cause problems. For example, images are affected by ozonic products, appearing as if flowing, when this charging apparatus is used for an extended period of time, in particular, when this charging apparatus is used in a cleanerless image forming apparatus for an extended period of time.

As described in the preceding paragraphs regarding the technologies prior to the present invention, it is difficult to directly charge an object using a contact type charging apparatus with a simple structure which comprises a contact type charging member such as a charge roller or a fur brush. Also in the case of an image forming apparatus which employs such a charging apparatus, the photosensitive member is liable to be insufficiently charged, causing images to appear foggy (during reversal development, toner is adhered to the areas which are supposed to remain white), or the photosensitive member is liable to be nonuniformly charged, causing image to be appear irregular in terms of continuity.

In a case of the contact type charging apparatus structured so that contact type charging member is coated with electrically conductive powder, the surface which comes in contact with the surface of the object to be charged (so that contact type charging member is rotated by the rotation of the photosensitive member, and so the photosensitive member is mainly charged by electrical discharge), ozonic products are liable to be accumulated, and images are affected by the accumulated ozonic products, appearing as if flowing, when such a charging apparatus is used for an extended period of time. In particular, when such a charging apparatus is used in a cleanerless image forming apparatus for an extended period of time.

Furthermore, in the case of the cleanerless image forming apparatus, there is the problem that residual toner causes the photosensitive member to be unsatisfactorily charged in a charging portion.

In contact charging, it is necessary that contact between the member to be charged and the charging member is sufficient.

A) When conventional fur brushes (charging brushes) are used as contact charging members, the fiber ends of the charging brush are divided as shown in FIG. 8, with the result that there is a portion where the brush does not contact the surface of the member to be charged, and therefore, the uniform charging of the surface of the member to be charged is deteriorated. In FIG. 8, 1 designates a member to be charged (for example, a photosensitive member); 2 is a charging brush; 2*a* is an electrode portion of the charging brush; 2*b* is a furbrush portion of the electroconductive fiber; and S1 is an electrode portion.

B) When the contact charging member is a magnetic brush and the size of the charging magnetic particles are reduced in an attempt to improve the contact property, the magnetic particles tend to be deposited on the surface of the member to be charged. If the size of the charging magnetic particles are increased with sufficient magnetic confining force, the chances of contact of the magnetic particles to the member to be charged reduce with the result of reduction of the injection charging power.

C) It is proposed that auxiliary electroconductive magnetic fine particles be added to the charging member in order to improve the contact property in the magnetic brush charging, but the magnetic fine particles be deposited on the member to be charged in a long run and therefore be consumed, with the result of charging property reduction.

U.S. Pat. No. 5,432,037 discloses that electroconductive particles are mixed in the developer so as not to disturb the charging action even when the developer is deposited onto the charging roller. However, since it uses electrical discharge for charging the member, it is not free of the problems described hereinbefore.

SUMMARY OF THE INVENTION

Accordingly, it is a principal object of the present invention to provide a charging device, a charging method, a process cartridge and an image forming apparatus, wherein uniform charging is maintained for a long term even if the use is made with a simple charging roller or fiber brush as the charging member.

It is another object of the present invention to provide a charging device, a charging method, a process cartridge and an image forming apparatus, wherein the applied voltage to the charging member can be reduced to accomplish the ozoneless charging operation.

It is a further object of the present invention to provide a charging device, a charging method, a process cartridge and an image forming apparatus, wherein the injection charging is accomplished from the charging member to the member to be charged at low cost.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 1 is a schematic illustration of an image forming apparatus of Embodiment 1.

FIG. 2 is a schematic illustration of a layer structure of a photosensitive member used therein.

FIG. 3 is a graph showing a charging property in the charge injection charging.

FIG. 4 is a model of the contact state between a charging brush and a photosensitive member when charging facilitator or promotion particles are provided.

FIG. 5 shows a visual sense property of human being.

FIG. 6 is a schematic illustration of an image forming apparatus of Embodiment 2.

FIG. 7 is a schematic illustration of a layer structure of a photosensitive member used in an image forming apparatus of Embodiment 3.

FIG. 8 shows a contact state between a charging brush and a photosensitive member.

FIG. 9 is a charging property graph in the cases of a roller charging, a furbrush charging and a magnetic brush charging.

DESCRIPTION OF THE PREFERRED EMBODIMENTS

<Embodiment 1> (FIGS. 1–5)

FIG. 1 shows an example of an image forming apparatus comprising a contact charging device according to an embodiment of the present invention. The image forming apparatus of this example is a laser beam printer of detachable process cartridge type and using a transfer type electrophotographic process.

(1) General arrangement of the exemplary printer

Designated by 1 is a rotatable drum type electrophotographic photosensitive member as an image bearing member (member to be charged). In this example, it is a negatively chargeable OPC photosensitive member having a diameter of 30 mm, and is rotated in the clockwise direction indicated by the arrow at a process speed (peripheral speed) of 100 mm/sec.

Designated by 2 is a roller-like charging brush (fur brush charger) as a contact charging member contacted to the photosensitive member 1, forming a charging nip n having a width of 3 mm relative to the photosensitive member 1, and is rotated in the direction opposite from the direction of movement the photosensitive member 1, namely, the clockwise direction indicated by the arrow at the speed of 500 rpm at the charging nip n. The charging brush 2, as the contact charging member, is contacted to the photosensitive member 1 with a peripheral difference speed so as to rub the photosensitive member 1. It is supplied with a DC charging bias of −700V from the charging bias applying voltage source S1, by which the outer surface of the rotatable photosensitive member 1 is uniformly and directly charged substantially to −680V.

The charged surface of the rotatable photosensitive member 1 is exposed to scanning exposure L of a laser beam which has been subjected to a strength modulation corresponding to time series electric digital pixel signals representative of an intended image information. The beam is emitted from a laser beam scanner 2, including a laser diode and a polygonal mirror. By this, the electrostatic latent image is formed on the peripheral surface of the rotatable photosensitive member 1, corresponding to the image information.

The electrostatic latent image is then developed into a toner image by a reverse development device 4 using a one-component magnetic insulative toner (negative charged toner) t in this example.

4*a* designates a non-magnetic developing sleeve as a developer carrying member having a diameter of 16 mm and containing a magnet 4*b*. The developing sleeve 4*a* is spaced from the photosensitive member 1 by approximately 300 μm, and is rotated at the same peripheral speed as the photosensitive member 1, codirectionally therewith, in a developing zone a where the sleeve is opposed to the photosensitive member 1.

The rotatable developing sleeve 4*a* is coated with a thin layer of developer (toner) t by a regulating blade 4*c*. The layer thickness of the developer on the rotatable developing sleeve 4*a* is regulated by the regulating blade 4*c*, and developer is electrically charged by the regulating blade 4*c*. The developer on the rotatable developing sleeve 4*a* is carried to a developing zone a where the sleeve 4*a* is opposed to the photosensitive member 1, by rotation of the sleeve 4*a*. The sleeve 4*a* is supplied with a developing bias voltage from a developing bias applying voltage source S2. The developing bias voltage is in the form of a sum of a DC voltage of −500V and a rectangular pulse AC voltage having a peak-to-peak voltage of 1600V and a frequency of 1800 Hz.

Developer (toner) t is a known one comprising binder resin, magnetic particles and charge control material, and has been produced through kneading, pulverization and classification. In this example, the weight average particle size (D4) of the toner t is 7 μm.

On the other hand, a transfer material P as a recording material is fed from an unshown sheet feeding portion, and is introduced, at a predetermined timing, to a nip (transfer portion) b formed between the rotatable photosensitive member 1 and the intermediate resistance transfer roller 5 as the contact type transferring means contacted thereto at a predetermined urging force. The transfer roller 5 is supplied with a predetermined transfer bias voltage from a transfer bias application voltage source S3. In this example, the transfer roller 5 has a resistance value of $5\times10^8$ Ohm, and is supplied with a DC voltage of +2000V.

The transfer material P introduced into the transfer portion b passes through the nip, and receives the toner image from the surface of the rotatable photosensitive member 1 transferred thereto by the electrostatic force and the urging force.

The transfer material P, now having the toner image, is separated from the surface of the photosensitive member 1, and is fed to a heat fixing type fixing device 6, where the toner image is fixed on the transfer material P. Finally, it is discharged as a print.

The surface of the photosensitive member 1 after the toner image transfer onto the transfer material P, is cleaned by a cleaning device 7 so that residual toner deposited contamination or the like is removed, and it is prepared for the next image formation.

Designated by 8 is a charge facilitator particle applying device for the surface of the photosensitive member 1, and functions to apply a predetermined amount of charge facilitator or promotion particles (charging assisting particles) m onto the surface of the photosensitive member 1 at a position between the cleaning device 7 and the charging brush 2. The charge facilitator particles m, applied on the surface of the photosensitive member 1 by the apparatus 8, are carried to a charge portion n, where the charging brush 2 as the contact charging member is contacted to the photosensitive member 1, by the rotation of the photosensitive member 1, so that contact charging is carried out for the photosensitive member 1 by the charging brush 2 while the charge facilitator particles m are present at the charge portion n.

In the printer of this example, the photosensitive member 1, the charging brush 2, the developing device 4, the cleaning device 7 and the charge facilitator particle applying device 8 (five process means) are unified into a cartridge PC, which is detachably mountable to a main assembly of the printer (cartridge type). The combination of the process means contained in the process cartridge is not limited to those. However, it is preferably that cartridge contains at least one of the photosensitive member 1, the charging brush 2, the developing device 4 and the cleaning device 7. Designated by 9 is a guiding and holding members for the process cartridge PC at the time of mounting and demounting of the process cartridge relative to the main assembly. The present invention is not limitedly applicable to the cartridge type.

(2) A photosensitive member

Referring to FIG. 2 which is an enlarged schematic section of a portion of the photosensitive member 1 provided with the charge injection layer employed in this embodiment, and depicts the laminar structure of the photosensitive member 1, the photosensitive member 1 in this embodiment, which is a negatively chargeable photosensitive member with organic photoconductor, is formed by coating the following first to fourth functional layers 12–15, in this order from the bottom, on a base member constituted of an aluminum cylinder (aluminum base) 11 with a diameter of 30 mm.

First layer 12: an undercoat layer constituted of approximately 20 microns thick of an electrically conductive layer, used to smooth out the defects of the aluminum base 11 and to prevent the moire caused by the reflection of an exposure laser beam.

Second layer 13: a positive charge injection prevention layer, and plays a role in preventing the positive charge from the aluminum base 11 from canceling the negative charge given to the surface portion of the photosensitive member 1. It is approximately a 1 micron thick layer of Amylan, the electrical resistance of which has been adjusted to approximately $10^6$ Ohm.cm (medium resistance) with the use of methoxymethyl nylon.

Third layer 14: a charge generation layer constituted of approximately 0.3 microns resin layer in which disazo pigment has been dispersed. It generates charge couples composed of a negative charge and a positive charge.

Fourth layer 15: a charge transfer layer composed of P-type semiconductor created by dispersing hydrazone in polycarbonate resin. Thus, the negative charge given to the surface portion of the photosensitive member 1 is not allowed to transfer through this layer, and only the positive charge generated in the charge generation layer is allowed to transfer to the outermost layer of the photosensitive member 1.

(3) Charging brush 2

In this example, the contact charging member is a roller-like charging brush 2.

A tape 2*b* of pile fibers of electroconductive rayon fiber REC-B available from Yunichika KABUSHIKI KAISHA, Japan, is wound spirally around the core metal 2*a* having a diameter of 6 mm into a brush roller having an outer diameter of 14 mm at 300 denier/50 filament and at the density of 155 per 1 mm square. Resistance value of the brush is $1\times10^5$ Ohm with the applied voltage of 1–1000V. The resistance value is measured on the basis of current by contacting the brush to a drum having a diameter of 30 mm with a nip width of 3 mm, and applying a the voltage of 100V.

The resistance value of the charging brush 2 is preferably not less than $10^4$ Ohm from the standpoint of preventing image defect due to improper charging resulting from excess leak current through a pin hole or the like of the photosensitive member 1, and from the standpoint of sufficient charge injection, not more than $10^7$ Ohm is preferable.

The materials of the charging brush other then the REC-B, include REC-C, REC-M1, REC-M10 available from the same company, SA-7 available from Toray Kabushiki Kaisha, Japan, THUNDERLON available from Nippon Sanmo Kabushiki Kaisha, Japan, BELTLON available from Kanebo Kabushiki Kaisha, Japan, KURACARBO available from Kuraray KABUSHIKI KAISHA, Japan, a material obtained by dispersing carbon in rayon, LOPAL available from MITSUBISHI RAYON Kabushiki Kaisha, Japan, or the like. From the standpoint of stability against ambience, REC-B, REC-C, REC-M1, REC-M10 available from Yunichika KABUSHIKI KAISHA, is preferable.

In this example, the charging brush 2 is rotated at rotational frequency 500 rpm in such a direction that surface thereof moves counterdirectionally with respect to the photosensitive member surface at the nip formed therebetween. The rotational frequency is not limited to this example, but is determined properly by one skilled in the art in consideration of the width of the charging nip n between the charging brush 2 and the photosensitive member 1, density of the brush fibers, the surface resistance of the photosensitive member, process speed (peripheral speed) or the like.

The peripheral movement of the charging brush at the nip may be codirectional with that of the photosensitive member surface. However, since the charging property in the injection charging is dependent on the ratio of the peripheral speeds of the charging brush 2 and the photosensitive member 1, the counterdirectional peripheral movement arrangement is preferable, otherwise the required rotational frequency of the charging brush 2 has to be higher than in the counterdirectional peripheral movement.

The peripheral speed ratio here is defined as follows:

Peripheral speed ratio(%)=((charging brush peripheral speed−photosensitive member peripheral speed)/photosensitive member peripheral speed)×100: where the charging brush peripheral speed is positive when the direction of movement thereof is codirectional with the photosensitive member surface.

(4) Charge facilitator particle m and charge injection charging

In charge injection charging, the direct charge injection is effected not through discharge phenomenon, but by using an intermediate resistance contact charging member. Therefore, even if the applied voltage to the contact charging member is lower than the charge starting threshold level, the photosensitive member can be charged to a potential corresponding to the applied voltage. FIG. 3 shows a relation between the applied DC voltage and the surface potential of the photosensitive member in this case.

The contact between the charging member and the surface of the photosensitive member is required to be sufficient. However, when use is made with a charging brush as the contact charging member, there arises a problem that fiber ends of the charging brush branch as shown in FIG. 8, with the result of a zone* where the brush does not contact the photosensitive member surface so that uniformity of charging is deteriorated, as has been discussed hereinbefore.

According to this embodiment, as shown in FIG. 1, there is provided an apparatus 8 for applying the charge facilitator particles m onto the surface of the photosensitive member 1 as the member to be charged, by which not less than $10^2$ particles/$mm^2$ of the charge facilitator particles m are applied onto the photosensitive member surface, and then, the problem was solved. The charge facilitator particle applying device 8 may use known means for applying particles. For example, the particles may be uniformly applied on an application roller 8a, and thereafter, contacted to, or caused to jump at, the photosensitive member.

FIG. 4 show a model wherein the charge facilitator particles m improve the chances of contact of the charging member (here, the free end portion of the fur brush).

In this embodiment, the preferably range of density of the applied charge facilitator particles is determined on the basis of a visual sense property of human being and on the basis of the experiments.

Recently, the recording resolution of laser beam printers is increasing from 300 dpi to, for example, 600 dpi. The charging has to be more uniform than this recording resolution.

FIG. 5 shows a visual sense property of the human being, and it will be understood that when the spatial frequency is not less than 10 (cycles/mm), the number of discriminatable gradations on an image approaches limitlessly to 1, and thus, it becomes impossible to discriminate a density non-uniformity.

By positively using this property, this embodiment presents the surface of the photosensitive member 1 with the charge facilitator particles m at a density not less than 10 (cycles/mm), and the contact injection charging is carried out with such distributed particles m.

Even if improper charging occurs at a place not having the particles m, the density non-uniformity in the image resulting from the improper charging has the spatial frequency exceeding the visual sense property, and therefore, there is no practical problem.

Table 1 shows whether or not the improper charging is recognizable as a density non-uniformity in the image when the application density of the charge facilitator particles m is changed.

TABLE 1

| applied amount (particles/$mm^2$) | improvement in charging property | objective evaluation of image quality |
|---|---|---|
| 0 | No | NG |
| $10^1$ | Yes | NG |
| $10^2$ | Yes | F |
| $10^3$ | Yes | G |
| $10^4$ | Yes | G |
| $10^5$ | Yes | G |

G: No image defect is recognized.
F: Image defect is hardly recognized.
NG: Image defect is recognizable.

G: No image defect is recognized.
F: Image defect is hardly recognized.
NG: Image defect is recognizable.

The application density of the charge facilitator particles m was measured by observation through an optical or electron microscope.

As will be understood from Table 1, a small amount of charge facilitator particles m, for example, 10 particles/$mm^2$, applied on the photosensitive member 1, is enough to suppress the charging non-uniformity occurrence, but the result is not enough from the standpoint of tolerance for humans visual sense.

When, however, the amount is not less than $10^2$/$mm^2$, the results of relative evaluation is suddenly improved.

When it is not less than $10^3$/$mm^2$, the problem due to the improper charging disappears.

The charging by the contact injection type, since essentially different from the discharging type, it is desirable that the contact of the charging member to the photosensitive member is assured. But, even if the charge facilitator particles m are applied on the photosensitive member 1, no contact zone necessarily results. By positively using the visual sense property of the human being, the problem was solved.

The upper limit of the application amount of the particles m, is determined by the very uniform application on the photosensitive member 1, and the application beyond that does not provide any further improvement, and conversely, the particles may scatter or block the image exposure light.

The upper limit of the application density is different if the particle size of each particle m is different, but generally one complete layer on the photosensitive member 1 is the upper limit.

If the amount of the charging particles exceeds $5\times10^5$/mm$^2$, the particles are remarkably held to the photosensitive member 1 which results in an exposure shortage of the photosensitive member 1, irrespective of the light transmissivity of the particle per se. If it is below $5\times10^5$ particle/mm$^2$, the amount of the charge facilitator particles 3 which depart from the photosensitive member 1 becomes moderate, and therefore, the harmful effect of the charge facilitator particles 3 is minimized. When the amount of the charge facilitator particles 3 which transferred onto the photosensitive member 1 while keeping the amount of the charge facilitator particles 3 between the charge roller 2 and the photosensitive member 1 in the above mentioned more desirable range was measured, it was within a range of $10^2$–$10^5$ particle/mm$^2$, which proves that the desirable amount of the charge facilitator particles 3 placed between the charge roller 2 and the photosensitive member 1 without harmfully affecting image formation is no more than $10^5$ particle/mm$^2$.

Next, the method used for measuring the amount of the charge facilitator particles 3 between the charge roller 2 and the photosensitive member 1, and the amount of the charge facilitator particles 3 on the photosensitive member 1, will be described. It is desirable that the amount of the charge facilitator particles 3 between the charge roller 2 and the photosensitive member 1 is directly measured in the charging nip n between the charge roller 2 and the photosensitive member 1. However, the amount of the charge facilitator particles on the charge roller 2 measured immediately before the charging nip n is substituted for the actual amount of the charge facilitator particles between the charge roller 2 and the photosensitive member 1. More specifically, the rotation of the photosensitive member 1 and charge roller 2 is stopped, and the peripheral surfaces of the photosensitive member 1 and the charge roller 2 are photographed by a video-microscope (product of Olympus: OVM1000N) and a digital still recorder (product of Deltis: SR-3100), without applying the charge bias. In photographing the peripheral surface of the charge roller 2, the charge roller 2 is pressed against a piece of slide glass under the same condition as the charge roller 2 is pressed against the photosensitive member, and no less then 10 spots in the contact area between the charge roller 2 and the slide glass were photographed with the use of the video-microscope fitted with an object lens with a magnification power of 1,000. The digital images obtained are digitally processed using a predetermined threshold. Then, the number of cells in which particles are present is calculated with the use of a designated image processing software. As for the amount of the charge facilitator particles on the photosensitive member 1, the peripheral surface of the photosensitive member 1 is photographed using the same video-microscope, and then, the obtained images are processed in the same manner to obtain the number of the charge facilitator particles on the photosensitive member 1.

The fur brush preferably has a high brush density, but the brush density used in this embodiment turned out to be enough. This is because what determines the charging points of the injection charging is mainly not the charging member, but the application density of the charge facilitator particles m, and therefore, the choice of the charging members is larger according to the embodiment.

The preferable particle size and property of the charge facilitator particles m are as follows:

The charge facilitator particles 3, which are in the nip between the charge roller 2 and the photosensitive member 1, are of electroconductive zinc oxide particles in this embodiment, but other materials, such as inorganic electroconductive particles, or mixture with organic material can be used. In this embodiment, the average particle diameter of the particles, inclusive of the secondary particles formed through adhesion of primary particles, is 3 microns, and their specific resistivity is $10^6$ Ohm.cm.

The specific resistance of the charge facilitator particles 3 is desired to be no more than $10^{12}$ Ohm.cm, and preferably, no more than $10^{10}$ Ohm.cm, since electrical charge is given or received through the charge facilitator particles 3. The specific resistance of the charge facilitator particles 3 is obtained using a tableting method. That is, first, a cylinder which measures 2.26 cm$^2$ in bottom area size is prepared. Then, 0.5 g of a material sample is placed in the cylinder, between the top and bottom electrodes, and the resistance of the material is measured by applying 100 V between the top and bottom electrodes while compacting the material between the top and bottom electrodes with a pressure of 15 kg. Thereafter, the specific resistivity of the sample material is calculated from the results of the measurement through normalization.

The uniform charging effect appears when the particle size is not more than 50 μm, but in view of the visual sense property of the human being, it is preferable that particle size is not more than approx. 5 μm, since then the influence of the improper charging portion to the image is hardly recognized visually.

The particle size of coagulated material of the particles is defined as an average particle size of the coagulated materials. As for the method of measuring the particle size, more than 100 particles are extracted using an optical or electron microscope, and the volume particle size distribution is calculated on the basis of a maximum arc distance in the horizontal direction, and the particle size is defined as the 50% average particle size.

The charge facilitator particles m may be in the form of primary particles or secondary particles. The state of coagulations is not material if they function to promote the charging, but the particle density is of importance.

<Embodiment 2> (FIGS. 9–10)

FIG. 6 shows a schematic illustration of an image forming apparatus according to an embodiment of the present invention. The exemplary image forming apparatus of this embodiment is a printer similar to the foregoing embodiment (FIG. 1), but the cleaning device 7 is omitted (cleanerless system), and the charge facilitator particle applying device 8 is omitted, and instead, the charge facilitator particles m are added to the developer (toner) powder t in the developing device 4. Thus the developing device 4 functions also as the charge facilitator particle supply and applying means.

Toner t is a known one comprising binder resin, magnetic particle and charge control material, and has been produced through kneading, pulverization and classification, and the charge facilitator particles m are added to the toner powder. The weight average particle size (D4) of the toner t is 7 μm, and the particle size of the electroconductive zinc oxide particle as the charge facilitator particle m is 3 μm. The charge facilitator particle m is capable of functioning as fluidizing material for the toner t when the particle size of the charge facilitator particle m is not less than 10 nm and not more than toner particle size.

The content of the charge facilitator particles m relative to the toner t is generally 0.01–20 parts by weight relative to 100 parts by weight of the toner.

With the cleaner-less system, the untransferred toner remaining on the surface of the rotatable photosensitive member 1 after the toner image is transferred onto the transfer material P, is not removed by a cleaner, and therefore, the residual toner reaches the developing zone a through the charge portion n by the rotation of the photosensitive member 1. Then, it is removed and collected by the developing device 4 (simultaneous development and cleaning) (toner recycling process).

An amount of the charge facilitator particles m mixed in the developer t of the developing device 4 transfers onto the photosensitive member 1 together with the toner during the reverse development action of the developing device 4 for the electrostatic latent image on the photosensitive member 1.

The toner image on the photosensitive member 1 is positively transferred onto the transfer material P (recording material) by the transfer bias at he transfer portion b, but the charge facilitator particle m, which is electroconductive, does not positively transfer to the transfer material P, and remains deposited on the photosensitive member 1.

Since there is no cleaning device provided, the untransferred toner and the remaining charge facilitator particles m remaining on the surface of the photosensitive member 1 after the image transfer, are carried to the charge portion n where the charging brush 2 is in contact with the photosensitive member 1, by the movement of the surface of the photosensitive member 1. Therefore, the contact charging of the photosensitive member 1 is carried out with the charge facilitator particles m present at the contact area between the photosensitive member 1 and charging brush 2.

Some of the untransferred toner and the charge facilitator particles m pass through the charge portion n, and the untransferred toner and the charge facilitator particles m deposited and mixed into the charging brush 2, are gradually discharged to the photosensitive member 1 from the charging brush 2, and therefore, the surface of the photosensitive member 1 having the remaining toner is exposed with a laser beam for latent image formation. Then, the latent image formed surface having the remaining toner reaches the developing zone a with the movement of the surface of the photosensitive member 1, where it is subjected to the simultaneous development and cleaning operation. More particularly, a cleaning electric field for transfer from the dark portion of the photosensitive member to the developing sleeve and the electric field for depositing the toner from the developing sleeve to the light portion of the photosensitive member, are formed.

In the case of the cleaner-less system, the charge facilitator particles m contained in the developer t of the developing device 4 transfer onto the surface of the photosensitive member 1 in the developing zone a upon the actuation of the apparatus, and are carried on the moving image carrying surface to the charge portion n through the transfer portion b so that fresh particles m are supplied to the charge portion n. Therefore, even if the amount of the charge facilitator particles m is reduced, or the particles m are deteriorated, the charging property is maintained, and the charging property is stable. Since the charge facilitator particles applied on the photosensitive member are not removed by the cleaning device, a sufficient amount of the charge facilitator particles m are always present on the photosensitive member surface, so that the charging properties are drastically improved only by external addition of a small amount of facilitator particles m.

Naturally, the untransferred toner is also reused, thus permitting effective use of the toner.

At the initial stage of the printing operation, no charge facilitator particles are supplied to the contact portion n between the charging brush 2 and the photosensitive member 1, and therefore, a proper amount of the charge facilitator particles are provided in the contact portion n.

<Embodiment 3> (FIG. 7)

In this embodiment, the apparatus of Embodiment 1 or 2 is modified such that resistance control is used for the surface layer of the photosensitive member 1 as the member to be charged.

In this embodiment, a charge injection layer is provided on the surface of the member to be charged so that resistance of the surface of the member to be charged is controlled to further stabilize the uniform charging.

FIG. 7 shows a schematic layer structure of the photosensitive member 1 having a surface charge injection layer. The photosensitive member 1 comprises an aluminum base 11, a primer layer 12, a positive charge injection preventing layer 13, a charge generating layer 14, a charge transfer layer 15 in this order (ordinary organic photosensitive member 1), as shown in FIG. 2, and further comprises a charge injection layer 16 thereon for improving the charging property.

The surface charge injection layer 16 has a resistance value which is lowered by dispersing $SnO_2$ ultra-fine electroconductive particles or the like as electroconductive particles (electroconductive filler) in curable resin material such as photo-curing type acrylic resin material as a binder.

More particularly, 70 weight % of $SnO_2$ particles having a particle size approximately 0.03 microns having a resistance lowered by doping antimony is dispersed in the resin material, on the basis of the resin material, and is applied on the surface.

The liquid thus prepared is applied by dip-coating into a thickness of 1 μm. Therefore, the resistance value is approximately $1\times10^{13}$ Ohm.cm. When the electroconductive particles are not dispersed, the resistance value is approximately $1\times10^{15}$ Ohm.cm. The measurements were carried out under the temperature of 25° C. and the humidity of 40%.

By using the photosensitive member having such a surface resistance value, good charging properties are provided.

The resistance of the surface layer is important from the standpoint of function of the charge injection layer 16. In the charging system using the direct injection of the charge, the charge is efficiently moved if the resistance of the member to be charged is lowered. On the other hand, from the standpoint of the function of the photosensitive member, it is required to keep the electrostatic latent image for a predetermined period of time, and therefore, the volume resistivity of the charge injection layer 16 is preferably between $1\times10^{9}$–$1\times10^{14}$ (Ohm.cm).

In the case of not using the charge injection layer 16 as in this embodiment, the equivalent effects are provided if the charge transfer layer 15 has the resistance in the above range.

The same advantages are provided when the use is made with an amorphous silicon photosensitive member or the like having a volume resistivity of approx. $10^{13}$ Ohm.cm.

By having the photosensitive member 1 subjected to the resistance control at the surface layer, the electrostatic latent image is properly maintained, and a sufficient charging property is provided even in the case of the high process speed, thus improving the direct charging system.

Others

1) The charge facilitator particle supplying and applying means 4 for the member to be charged 1 or the contact charging member 2 is not lifted to those described in the foregoing, and as an alternative arrangement, a foam or fur brush containing the charge facilitator particles m may be contacted to the member to be charged 1 or the contact charging member 2.

2) The contact charging member 2 may be in the form of a felt, textile or the like. Or may be laminated to provide proper elasticity and/or electroconductivity. The contact changing member 2 may also be in the form of a charging roller.

The charge bias applied to a contact type charging member or the development bias applied to a development sleeve may be a compound voltage composed of DC voltage and an alternative voltage (AC voltage).

The waveform of the alternating voltage is optional; the alternating wave may be in the form of a sine wave, a rectangular wave, a triangular wave, or the like. Also, the alternating current may be constituted of an alternating current in the rectangular form which is generated by periodically turning on and off a DC power source. In other words, the waveform of the alternating voltage applied, as the charge bias, to a charging member or a development member may be optional as long as the voltage value periodically changes.

4) The choice of the means for exposing the surface of an image bearing member to form an electrostatic latent image need not be limited to a laser based digital exposing means described in the preceding embodiments. It may be an ordinary analog exposing means, a light emitting element such as a LED, or a combination of a light emitting element such as a fluorescent light and a liquid crystal shutter. In other words, the means of exposing the surface does not matter as long as it can form an electrostatic latent image which corresponds to the optical information of a target image.

An image bearing member may be constituted of a dielectric member with an electrostatic recording faculty. In the case of such a dielectric member, the surface of the dielectric member is uniformly charged to a predetermined polarity and a predetermined potential level (primary charge), and then, the charge given to the surface of the dielectric member is selectively removed with the use of a charge removing means such as a charge removing needle head or an electron gun to write, or form, the electrostatic latent image of a target image on the surface.

5) In the embodiments, the developing device 4 has been described as a one-component, non-contact type developing device using a magnetic developer, but a non-contact type developing device using a two component developer or a non-magnetic developer, can also be used. It may be a one-component, or a two component contact type developing device.

6) The recording material which receives the toner image from the photosensitive member 1 may be an intermediary transfer member such as a transfer drum.

One example of a method for measuring the size of toner particles is as follows. A Coulter counter TA-2 (product of Coulter Co., Ltd.) measuring apparatus, an interface (product of NIPPON KAGAKU SEIKI) through which the values of the average diameter distribution and average volume distribution of the toner particles are outputted, and a personal computer (Canon CX-1), are connected.

In measuring, 0.1–5 ml of surfactant, which is desirably constituted of alkylbenzene sulfonate, is added as dispersant in 100–150 ml to an electrolytic solution of 1% water solution of NaCl (first class sodium chloride), and then, 0.5–50 mg of the toner particles are added.

Next, the electrolytic solution in which the toner particles are suspended is processed approximately 1–3 minutes by an ultrasonic dispersing device. Then, the distribution of the toner particles measuring 2–40 microns in particle size is measured with the use of the aforementioned Coulter counter TA-2, the aperture of which is set at 100 microns, and the volumetric average distribution of the toner particles is obtained. Finally, the volumetric average particle size of the toner particles is calculated from the thus obtained volumetric average distribution of the toner particles.

While the invention has been described with reference to the structures disclosed herein, it is not confined to the details set forth and this application is intended to cover such modifications or changes as may come within the purposes of the improvements or the scope of the following claims.

What is claimed is:

1. A charging device comprising:

a charging member to which a voltage is applicable to charge a member to be charged, said charging member including a flexible member for forming a nip with said member to be charged, wherein said flexible member is moved to provide a speed difference between a surface of said member to be charged and a surface of said flexible member;

wherein not less than $10^2/mm^2$ of electroconductive particles are provided in said nip.

2. A device according to claim 1, wherein the volume resistivity of said electroconductive particles is not more than $1\times10^{12}$ Ohm.cm.

3. A device according to claim 1, wherein a volume resistivity of said electroconductive particles is not more than $1\times10^{10}$ Ohm.cm.

4. A device according to claim 1, wherein said electroconductive particles are non-magnetic.

5. A device according to claim 1, wherein the size of each said electroconductive particle is not more than 5 μm.

6. A device according to claim 1, wherein the size of each said electroconductive particle is not less than 20 nm.

7. A device according to claim 1, wherein said charging member is positioned such that the direction of movement of said flexible member is opposite to the direction of movement of said member to be charged at said nip.

8. A device according to claim 1, wherein said flexible member is an elastic member.

9. A device according to claim 1, further comprising supply means for supplying said electroconductive particles to said member to be charged.

10. A device according to claim 1, wherein said flexible member is in the form of a fiber brush.

11. A device according to any one claims 1–10, wherein said charging member performs injection charging for said member to be charged at said nip.

12. A charging method comprising the steps of:

providing a charging member to which a voltage is applicable to charge a member to be charged, wherein said charging member includes a flexible member for forming a nip with said member to be charged;

providing not less than $10^2/mm^2$ of electroconductive particles in said nip; and moving said flexible member to provide a speed difference between a surface of said member to be charged and a surface of said flexible member.

13. A method according to claim 12, wherein a volume resistivity of said electroconductive particles is not more than $1\times10^{12}$ Ohm.cm.

14. A method according to claim 12, wherein a volume resistivity of said electroconductive particles is not more than $1\times10^{10}$ Ohm.cm.

15. A method according to claim 12, wherein said electroconductive particles are non-magnetic.

16. A method according to claim 12, wherein the size of each said electroconductive particle is not more than 5 μm.

17. A method according to claim 12, wherein the size of each said electroconductive particle is not less than 20 nm.

18. A method according to claim 12, wherein said charging member is positioned such that the direction of movement of said flexible member is opposite to the direction of movement of said member to be charged at said nip.

19. A method according to claim 12, wherein said flexible member is an elastic member.

20. A method according to claim 12, wherein said flexible member is in the form of a fiber brush.

21. A method according to any one of claims 12–20, wherein said charging member performs injection charging for said member to be charged at said nip.

22. A process cartridge detachably mountable to an image forming apparatus, comprising:

a member to be charged capable of carrying an image;

a charging member to which a voltage is applicable to charge said member to be charged, said charging member including a flexible member for forming a nip with said member to be charged, wherein said flexible member is moved relative to said member to be charged to provide a difference in speed between a surface of said member to be charged and a surface of said flexible member; wherein not less than $10^2/mm^2$ of electroconductive particles are provided in said nip.

23. A process cartridge according to claim 22, wherein the volume resistivity of said electroconductive particles is not more than $1\times10^{12}$ Ohm.cm.

24. A process cartridge according to claim 22, wherein the volume resistivity of said electroconductive particles is not more than $1\times10^{10}$ Ohm.cm.

25. A process cartridge according to claim 22, wherein said electroconductive particles are non-magnetic.

26. A process cartridge according to claim 22, wherein the size of each said electroconductive particle is not more than 5 μm.

27. A process cartridge according to claim 22, wherein the size of each said electroconductive particle is not less than 20 nm.

28. A process cartridge according to claim 22, wherein said charging member is positioned such that the direction of movement of said flexible member is opposite to the direction of movement of said member to be charged at said nip.

29. A process cartridge according to claim 22, wherein said flexible member is an elastic member.

30. A process cartridge according to claim 22, further comprising supply means for supplying said electroconductive particles to said member to be charged.

31. A process cartridge according to claim 22, wherein said flexible member is in the form of a fiber brush.

32. A process cartridge according to any one claims 22–31, wherein said charging means performs injection charging for said member to be charged at said nip.

33. A process cartridge according to claim 22, wherein said member to be charged is provided with a surface layer having a volume resistivity of not more than $1\times10^{14}$ Ohm.cm.

34. A process cartridge according to claim 33, wherein said surface layer has a volume resistivity of not less than $1\times10^{9}$ Ohm.cm.

35. A process cartridge according to claim 34, wherein said member to be charged is provided with an electrophotographic photosensitive layer within said surface layer.

36. An image forming apparatus comprising:

a member to be charged capable of carrying an image;

a charging member to which a voltage is applicable to charge said member to be charged, said charging member including a flexible member for forming a nip with said member to be charged, wherein said flexible member is moved to provide a difference in speed between a surface of said member to be charged and a surface of said flexible member; wherein not less than $10^2/mm^2$ of electroconductive particles are provided in said nip.

37. An apparatus according to claim 36, wherein the volume resistivity of said electroconductive particles is not more than $1\times10^{12}$ Ohm.cm.

38. An apparatus according to claim 36, wherein the volume resistivity of said electroconductive particles is not more than $1\times10^{10}$ Ohm.cm.

39. An apparatus according to claim 36, wherein said electroconductive particles are non-magnetic.

40. An apparatus according to claim 36, wherein the size of each said electroconductive particle is not more than 5 μm.

41. An apparatus according to claim 36, wherein the size of each said electroconductive particle is not less than 20 nm.

42. An apparatus according to claim 36, wherein said charging member is positioned such that the direction of movement of said flexible member is opposite to the direction of movement of said member to be charged at said nip.

43. An apparatus according to claim 36, wherein said flexible member is an elastic member.

44. An apparatus according to claim 36, further comprising supply means for supplying said electroconductive particles to said member to be charged.

45. An apparatus according to claim 36, wherein said flexible member is in the form of a fiber brush.

46. An apparatus according to any one claims 36–45, wherein said charging member performs injection charging for said member to be charged at said nip.

47. An apparatus according to claim 36, wherein said member to be charged is provided with a surface layer having a volume resistivity of not more than $1\times10^{14}$ Ohm.cm.

48. An apparatus according to claim 47, wherein said surface layer has a volume resistivity of not less than $1\times10^{9}$ Ohm.cm.

49. An apparatus according to claim 48, wherein said member to be charged is provided with an electrophotographic photosensitive layer inside said surface layer.

50. An apparatus according to claim 36, wherein said image forming means includes developing means for developing an electrostatic latent image formed on said member to be charged with toner, and developing means capable of removing residual toner from said member to be charged.

51. An apparatus according to claim 50, wherein said developing means is capable of effecting a cleaning operation while effecting a developing operation.

* * * * *

UNITED STATES PATENT AND TRADEMARK OFFICE

CERTIFICATE OF CORRECTION

PATENT NO. : 6,081,681
DATED : June 27, 2000
INVENTOR(S) : Yuki Nagase et al.

It is certified that error appears in the above-identified patent and that said Letters Patent is hereby corrected as shown below:

Column 9,
Line 67, “preferably” should read -- preferable --.

Column 12,
Line 1, “preferably” should read -- preferable --.

Column 17,
Line 9, “lifted” should read -- limited --.

Column 19,
Line 64, “one” should read -- one of --; and
Line 65, “means” should read -- member --.

Signed and Sealed this

Twenty-fifth Day of January, 2005

JON W. DUDAS
*Director of the United States Patent and Trademark Office*